US010429055B2

(12) United States Patent
Kim et al.

(10) Patent No.: US 10,429,055 B2
(45) Date of Patent: Oct. 1, 2019

(54) LIGHTING MODULE AND LIGHTING APPARATUS INCLUDING SAME

(71) Applicant: LG Innotek Co., Ltd., Seoul (KR)

(72) Inventors: Jin Wook Kim, Seoul (KR); Yeo Jun Yun, Seoul (KR); Ji Hwan Jeon, Seoul (KR); Bu Kwan Je, Seoul (KR)

(73) Assignee: LG INNOTEK CO., LTD., Seoul (KR)

( * ) Notice: Subject to any disclaimer, the term of this patent is extended or adjusted under 35 U.S.C. 154(b) by 162 days.

(21) Appl. No.: 15/301,669

(22) PCT Filed: Apr. 2, 2015

(86) PCT No.: PCT/KR2015/003335
§ 371 (c)(1),
(2) Date: Oct. 3, 2016

(87) PCT Pub. No.: WO2015/152667
PCT Pub. Date: Oct. 8, 2015

(65) Prior Publication Data

US 2017/0114993 A1 Apr. 27, 2017

(30) Foreign Application Priority Data

Apr. 4, 2014 (KR) ..... 10-2014-0040513
Apr. 4, 2014 (KR) ..... 10-2014-0040514
(Continued)

(51) Int. Cl.
*F21V 31/00* (2006.01)
*F21V 29/80* (2015.01)
(Continued)

(52) U.S. Cl.
CPC ..... *F21V 29/80* (2015.01); *F21K 9/20* (2016.08); *F21V 5/007* (2013.01); *F21V 5/04* (2013.01);
(Continued)

(58) Field of Classification Search
CPC . F21V 29/80; F21V 5/007; F21V 5/04; F21V 27/02; F21V 31/00; F21V 29/00;
(Continued)

(56) References Cited

U.S. PATENT DOCUMENTS 1,381,073 A * 6/1921 Johnson ..... H02G 3/22 174/81
2,180,096 A * 11/1939 Thomas, Jr. ..... H02G 3/22 174/78
(Continued)

FOREIGN PATENT DOCUMENTS

CN 102650379 A 8/2012
JP 2012-119283 A 6/2012
(Continued)

*Primary Examiner* — Bao Q Truong
*Assistant Examiner* — Fatima N Farokhrooz
(74) *Attorney, Agent, or Firm* — Birch, Stewart, Kolasch & Birch, LLP

(57) ABSTRACT

The embodiments discloses a lighting module. The lighting module disclosed in the embodiments comprises: a heat dissipating plate including a plurality of heat dissipating fins at the lower portion thereof; a light emitting module having a printed circuit board coupled on the heat dissipating plate, and a plurality of light emitting devices disposed on the printed circuit board; a lens cover disposed on the light emitting module and having a plurality of lens units corresponding to the light emitting devices, respectively; and a waterproof frame disposed between the upper periphery of the heat dissipating plate and the lens cover, wherein the waterproof frame includes a first waterproof projection projecting in a direction toward the bottom surface of the lens cover and a second waterproof projection projecting in a direction toward the top surface of the heat dissipating plate.

21 Claims, 20 Drawing Sheets

(30) Foreign Application Priority Data

Apr. 4, 2014 (KR) ..... 10-2014-0040515
Apr. 4, 2014 (KR) ..... 10-2014-0040783

(51) Int. Cl.

| | |
|---|---|
| ***F21V 5/04*** | (2006.01) |
| ***F21V 17/12*** | (2006.01) |
| ***F21V 27/02*** | (2006.01) |
| ***F21V 5/00*** | (2018.01) |
| ***F21K 9/20*** | (2016.01) |
| *F21V 17/00* | (2006.01) |
| *F21V 23/06* | (2006.01) |
| *F21Y 105/10* | (2016.01) |
| *F21Y 115/10* | (2016.01) |
| *F21W 131/103* | (2006.01) |

(52) U.S. Cl.
CPC ..... *F21V 17/12* (2013.01); *F21V 27/02* (2013.01); *F21V 31/00* (2013.01); *F21V 31/005* (2013.01); *F21V 17/005* (2013.01); *F21V 23/06* (2013.01); *F21W 2131/103* (2013.01); *F21Y 2105/10* (2016.08); *F21Y 2115/10* (2016.08)

(58) Field of Classification Search
CPC ..... F21V 31/005; F21V 17/12; F21V 17/005; F21V 23/06; F21Y 2115/10; F21Y 2105/10; F21W 2131/103; F21K 9/20
See application file for complete search history.

(56) References Cited

U.S. PATENT DOCUMENTS

| | | | | |
|---|---|---|---|---|
| 2,866,173 | A * | 12/1958 | Newcombe | H01F 27/04 174/145 |
| 3,151,212 | A * | 9/1964 | Rogers | H01Q 1/14 174/156 |
| 8,235,550 | B2 * | 8/2012 | Kong | F21S 8/086 362/249.02 |
| 2008/0298058 | A1 * | 12/2008 | Kan | F21V 15/01 362/240 |
| 2009/0034255 | A1 * | 2/2009 | Li | F21S 8/086 362/249.02 |
| 2009/0168416 | A1 * | 7/2009 | Zhang | F21S 8/086 362/234 |
| 2009/0237930 | A1 * | 9/2009 | Li | F21S 8/086 362/235 |
| 2010/0027255 | A1 | 2/2010 | Chang et al. | |
| 2011/0103059 | A1 * | 5/2011 | Chen | F21V 5/007 362/249.02 |
| 2012/0087125 | A1 * | 4/2012 | Liu | F21S 2/005 362/241 |
| 2012/0218758 | A1 * | 8/2012 | Wang | F21S 8/086 362/244 |
| 2013/0148360 | A1 * | 6/2013 | Jeon | F21V 31/03 362/294 |
| 2014/0268830 | A1 * | 9/2014 | Boyer | F21V 21/14 362/382 |
| 2015/0036387 | A1 * | 2/2015 | Myers | F21V 23/06 362/646 |

FOREIGN PATENT DOCUMENTS

| | | | |
|---|---|---|---|
| JP | 2012-194581 | A | 10/2012 |
| KR | 10-2010-0118401 | A | 11/2010 |
| KR | 10-1059084 | B1 | 8/2011 |
| KR | 10-1284261 | B1 | 7/2013 |
| KR | 20-0468256 | B1 | 8/2013 |
| KR | 200468256 | * | 8/2013 |
| KR | 10-1376079 | B1 | 3/2014 |
| TW | M382586 | U | 6/2010 |

* cited by examiner

【FIG. 1】
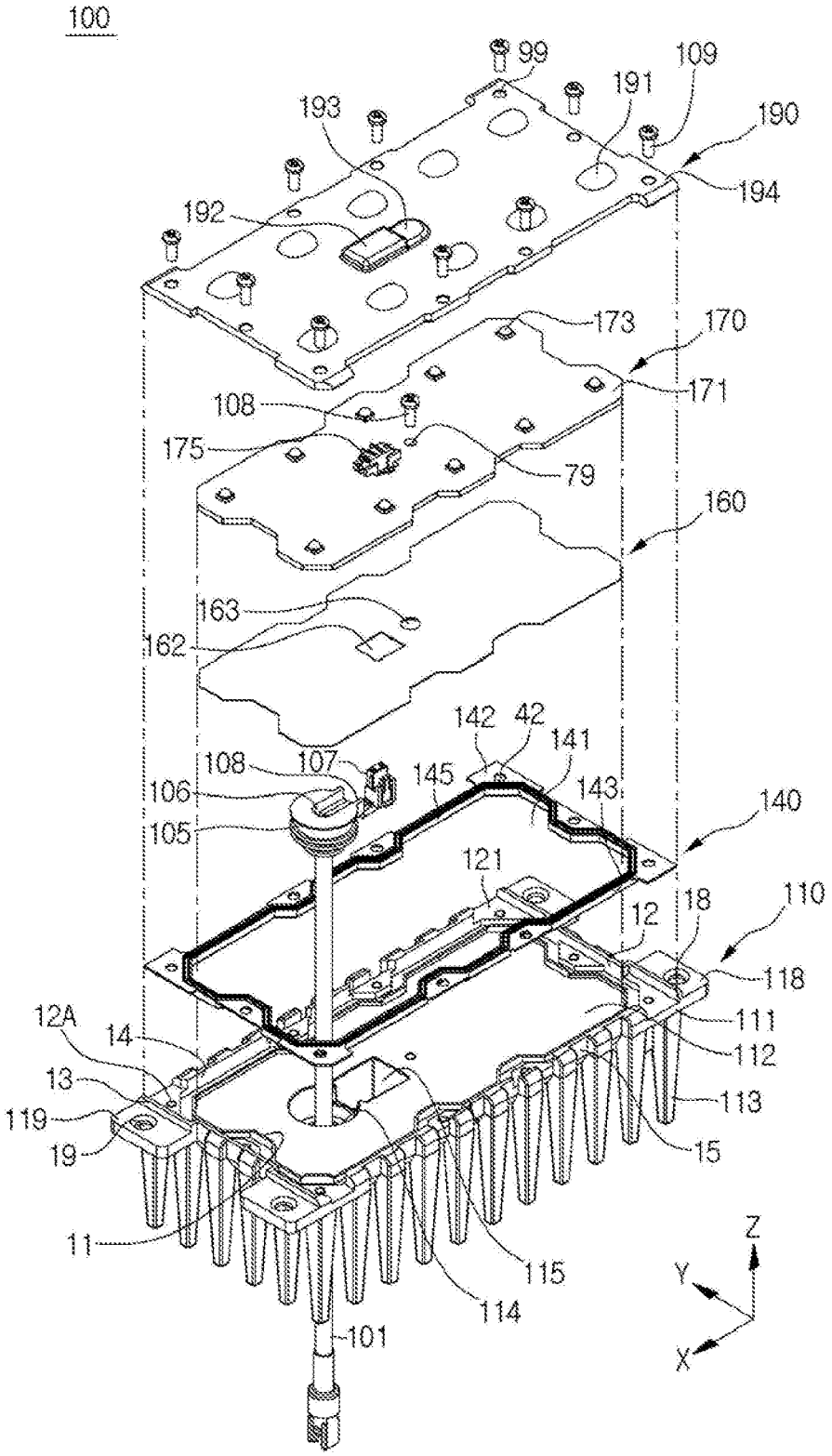

【FIG. 2】
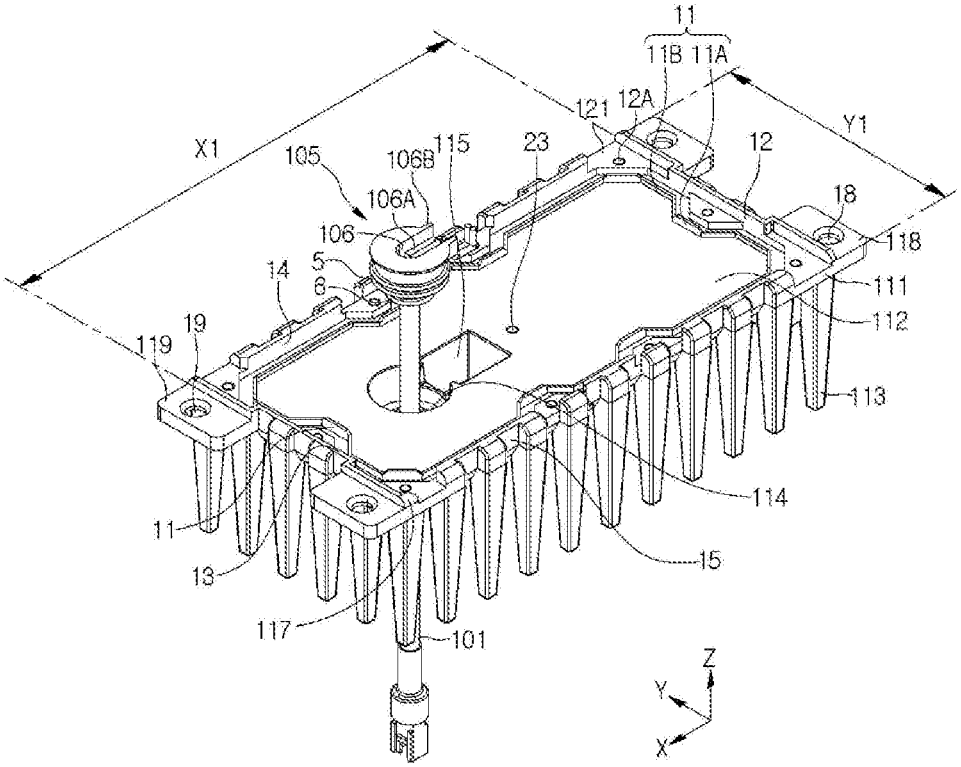

【FIG. 3】
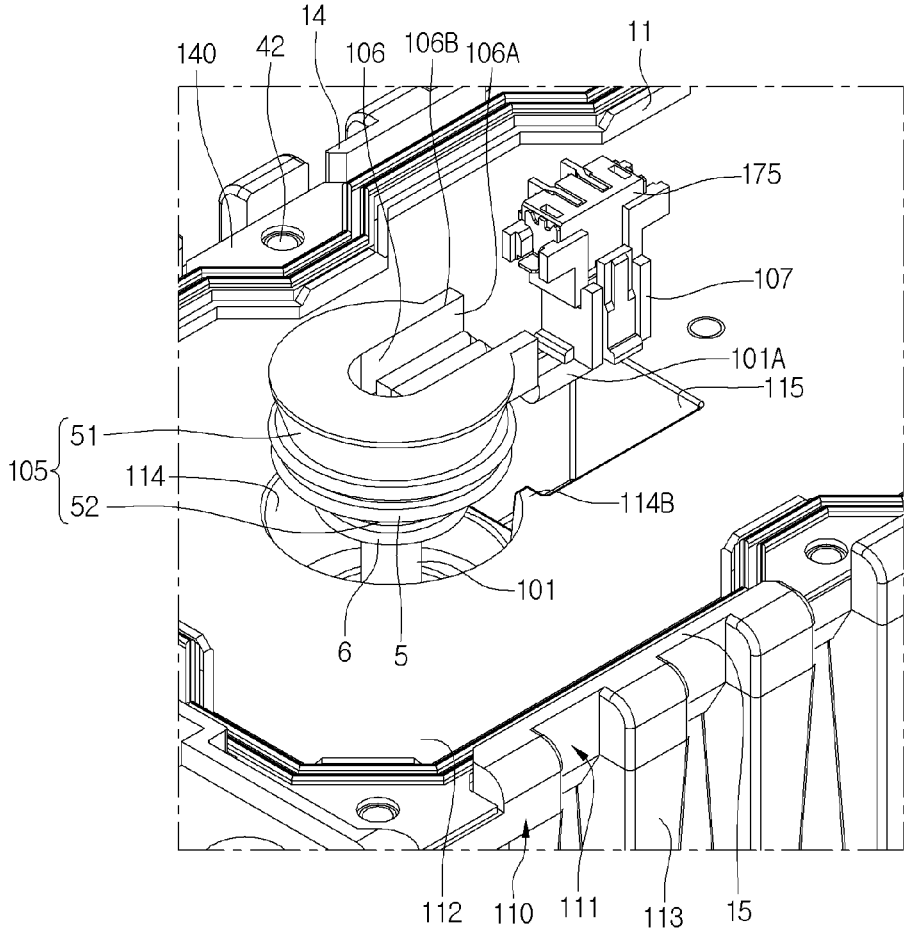

【FIG. 4】
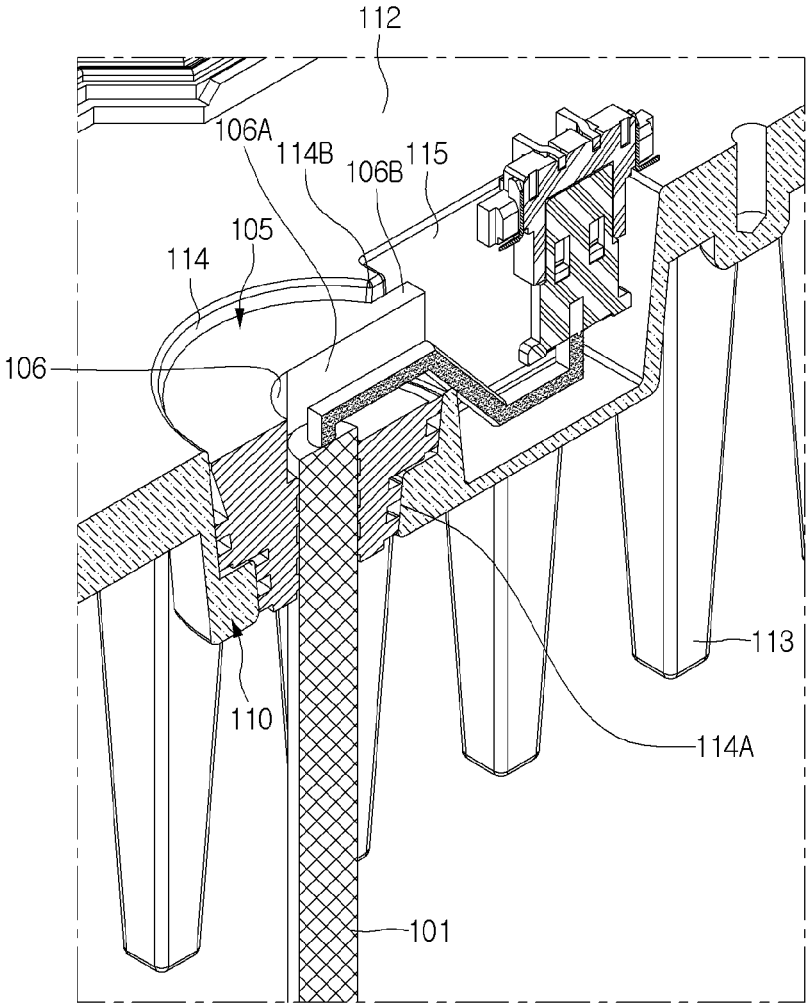

【FIG. 5】
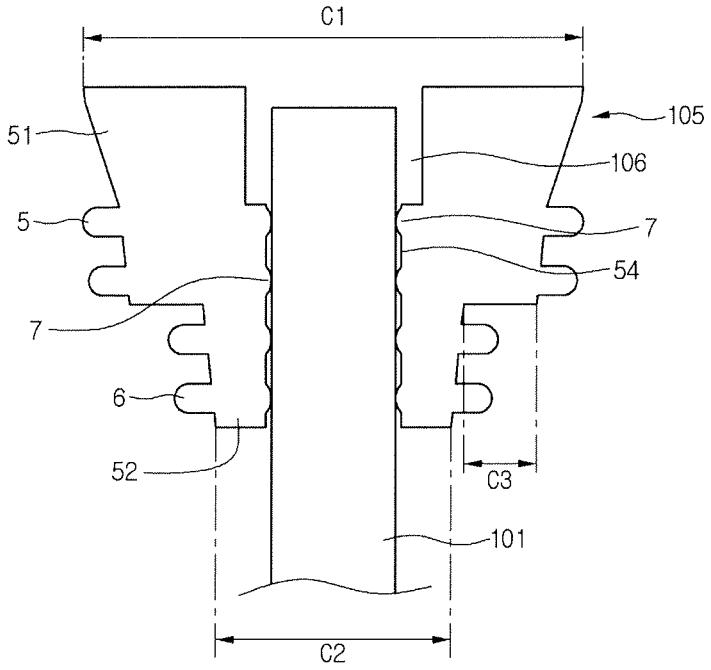

【FIG. 6A】
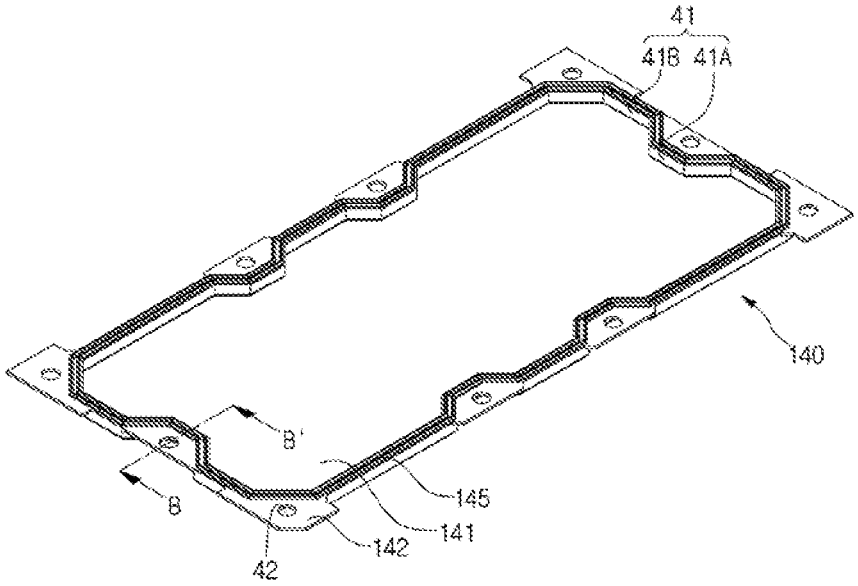
【FIG. 6B】
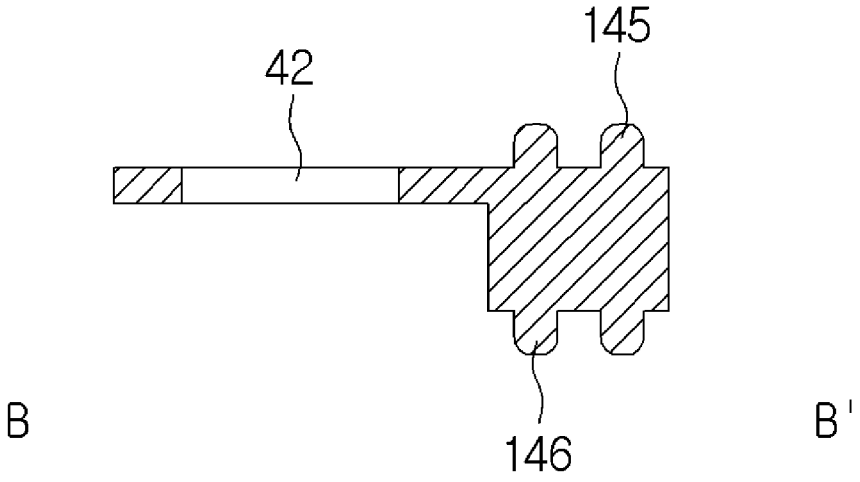

【FIG. 7】
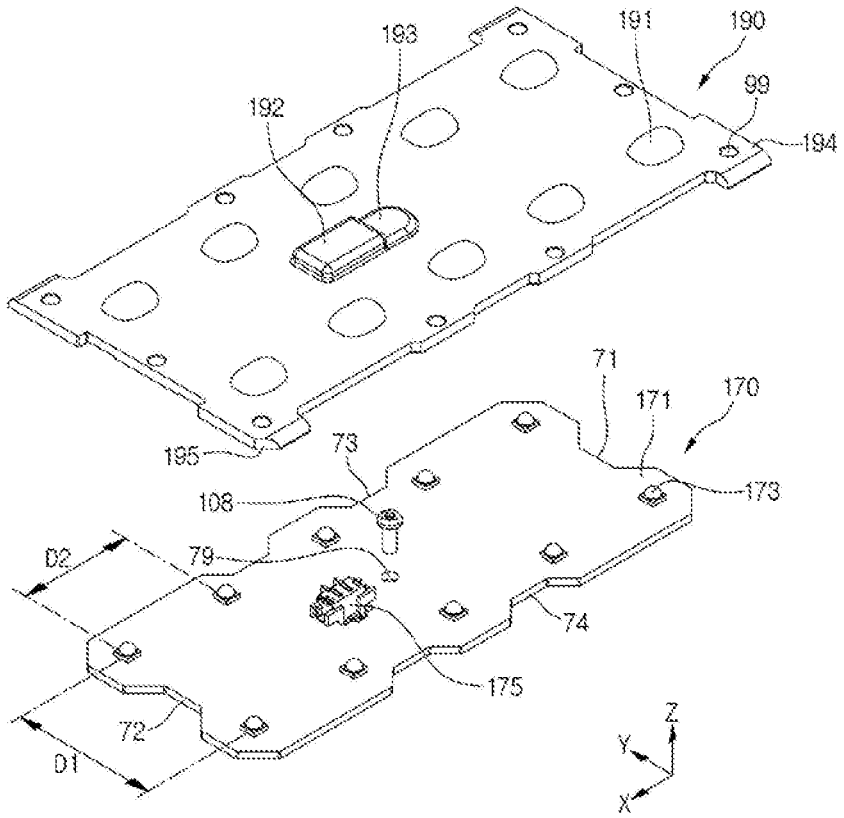

【FIG. 8】
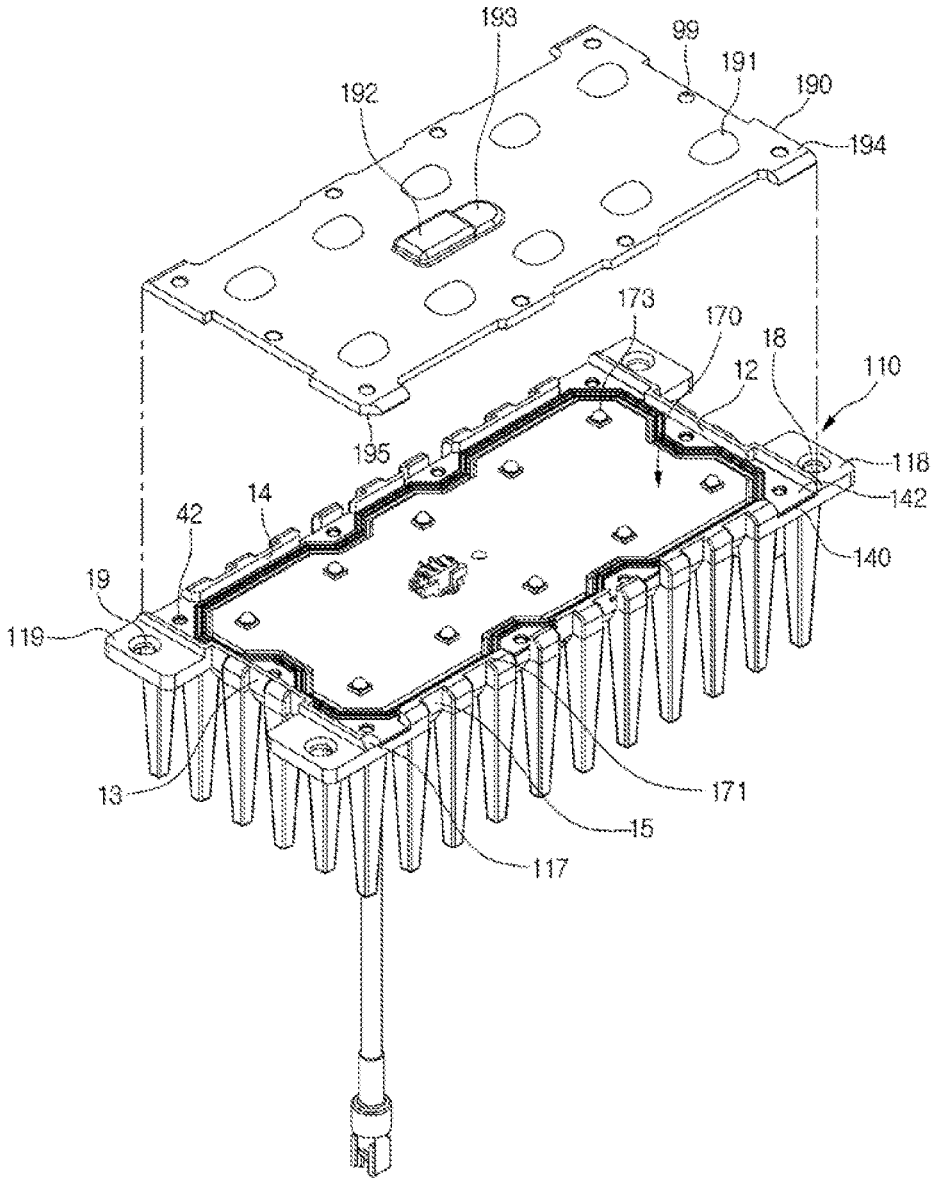

【FIG. 9】
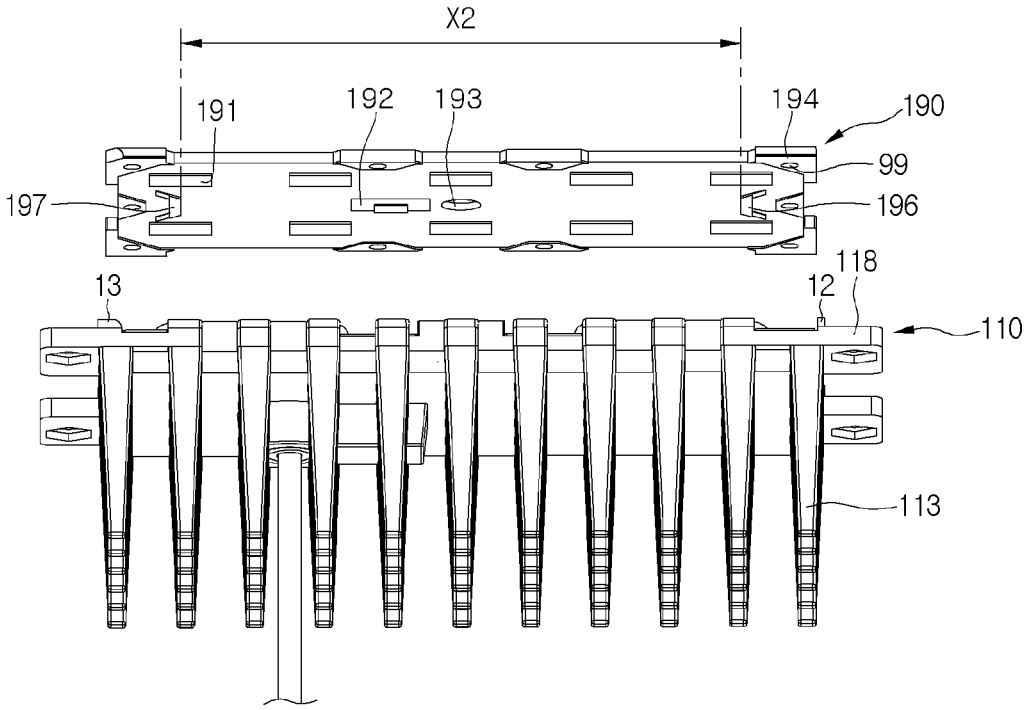

【FIG. 10】
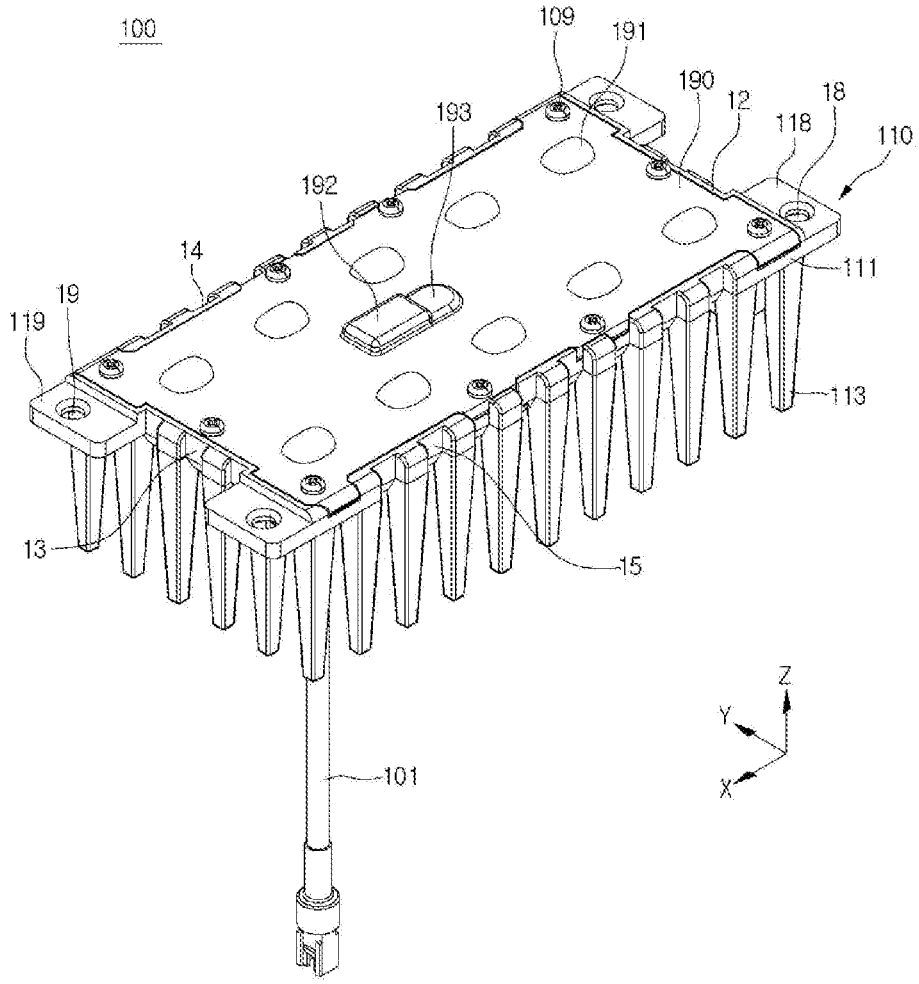

【FIG. 11】
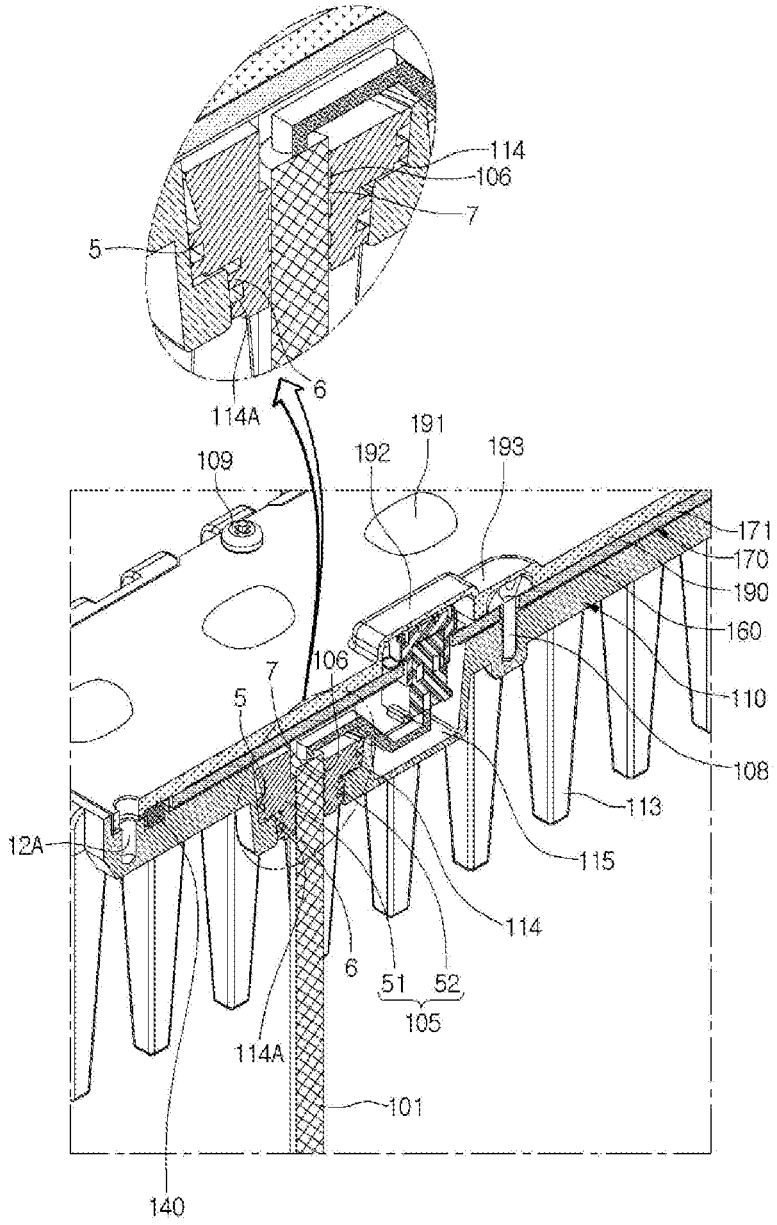

【FIG. 12】
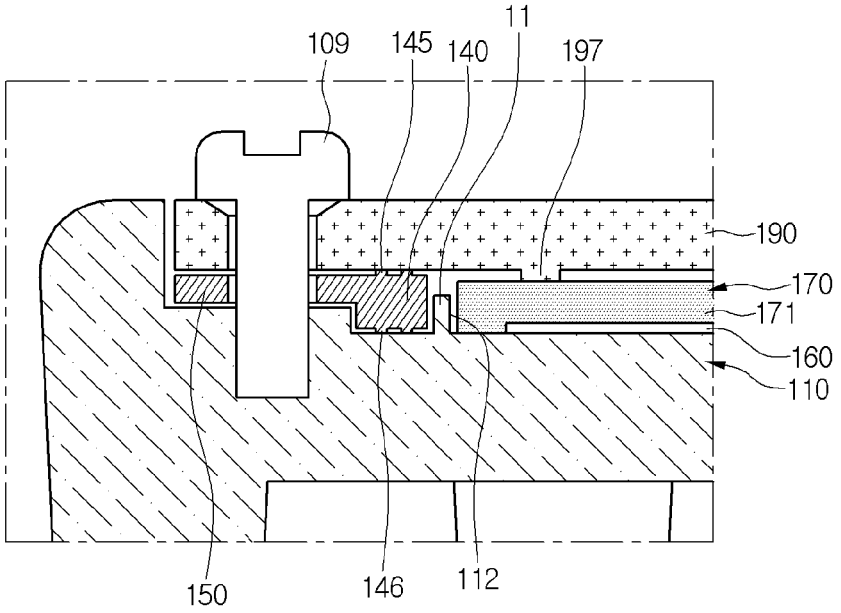
【FIG. 13】
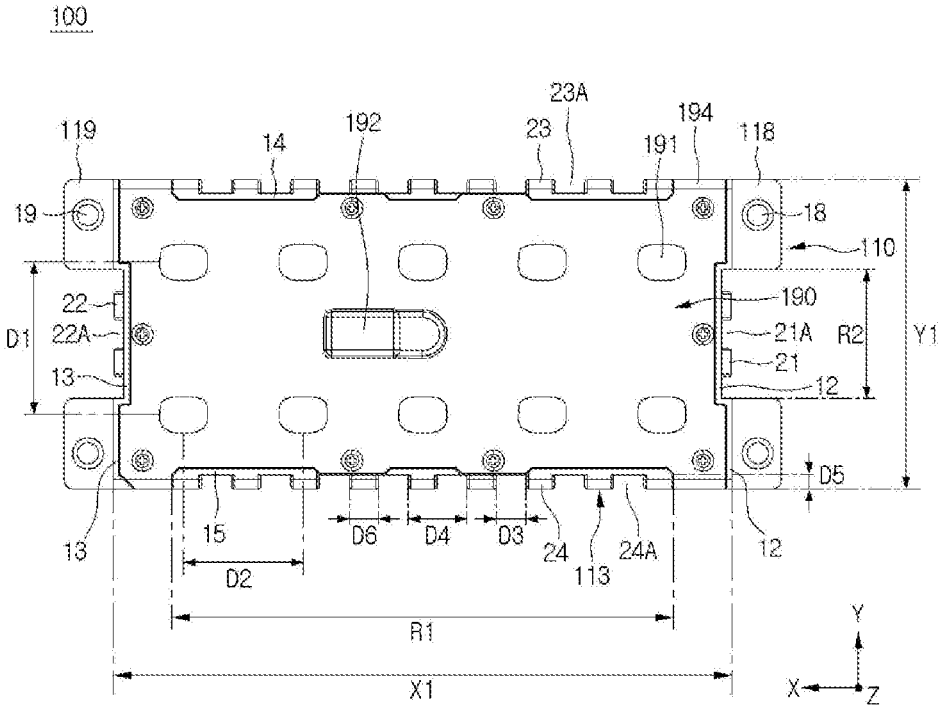

【FIG. 14】
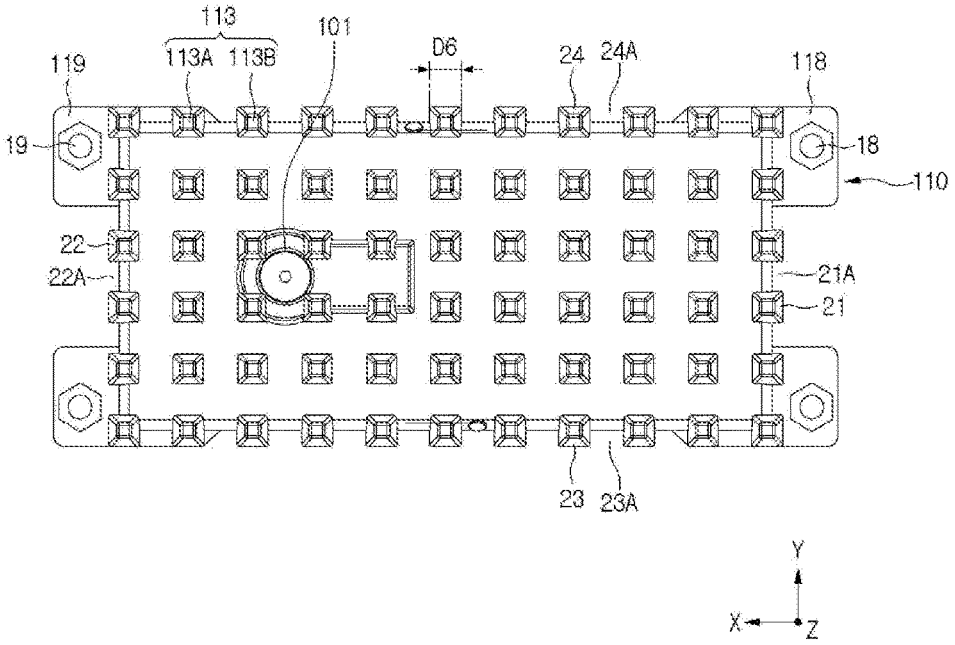
【FIG. 15】
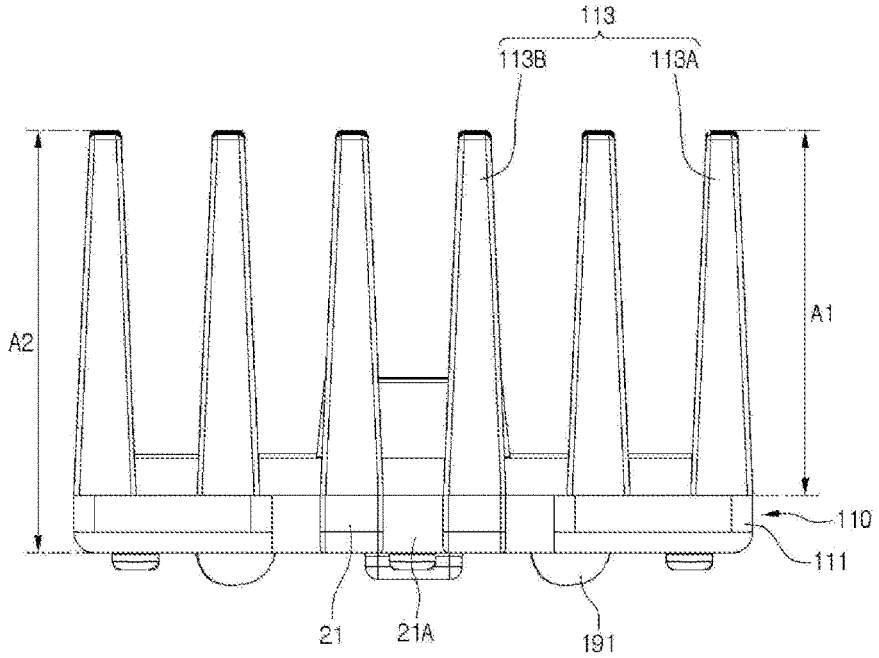

【FIG. 16】
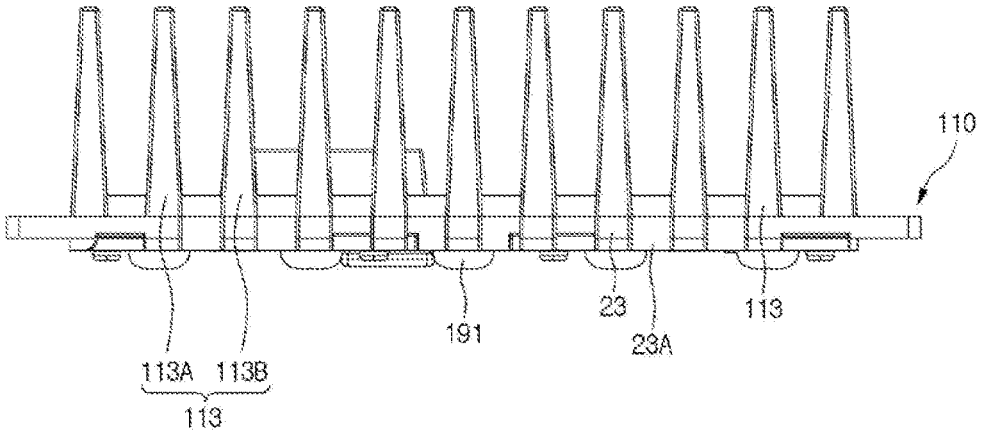
【FIG. 17】
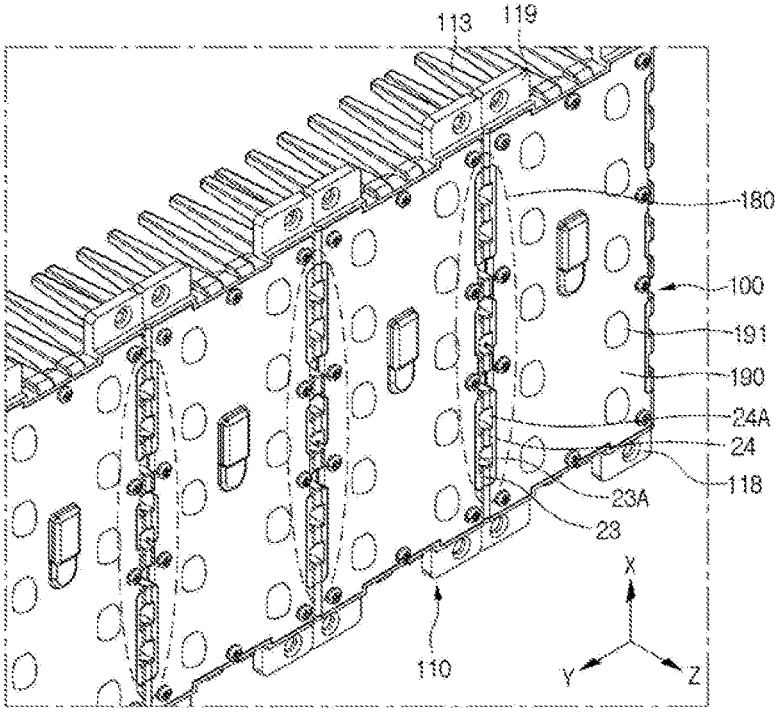

【FIG. 18】
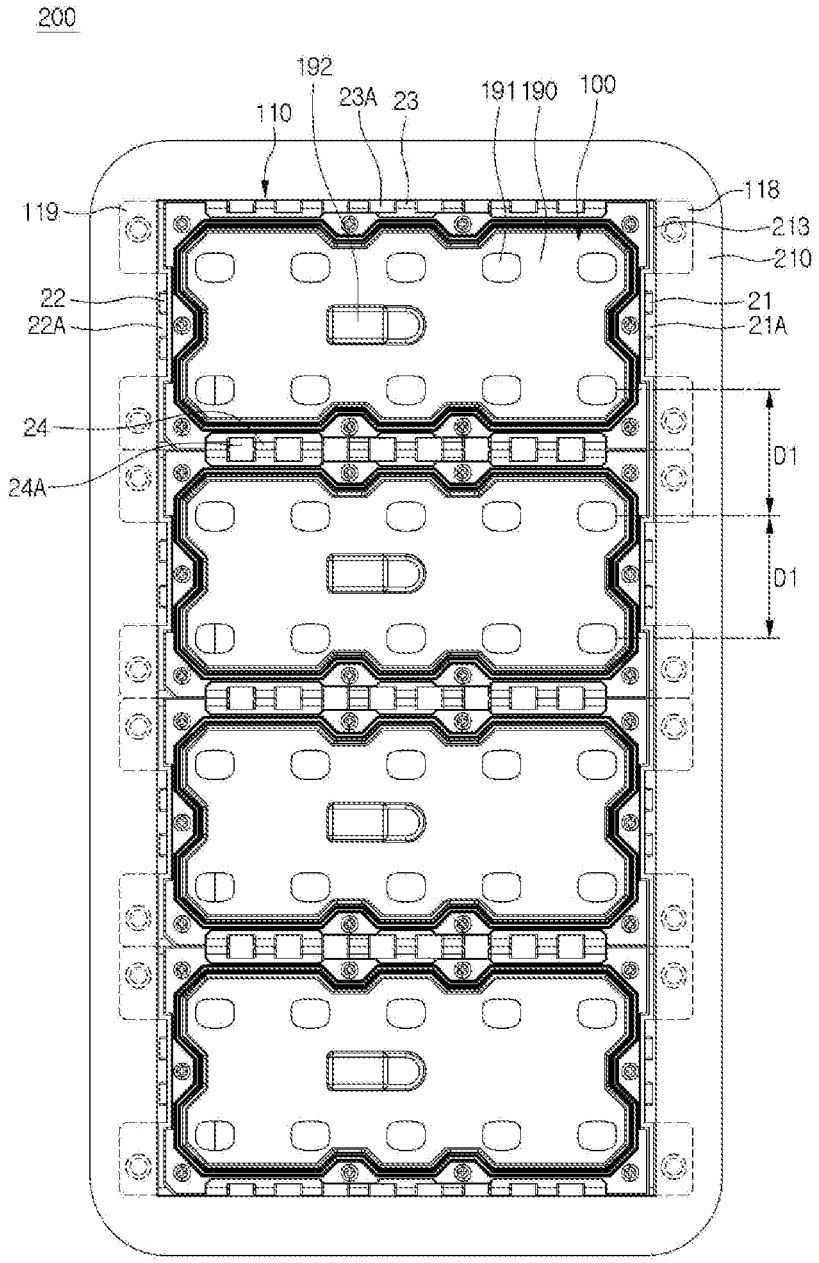

【FIG. 19】
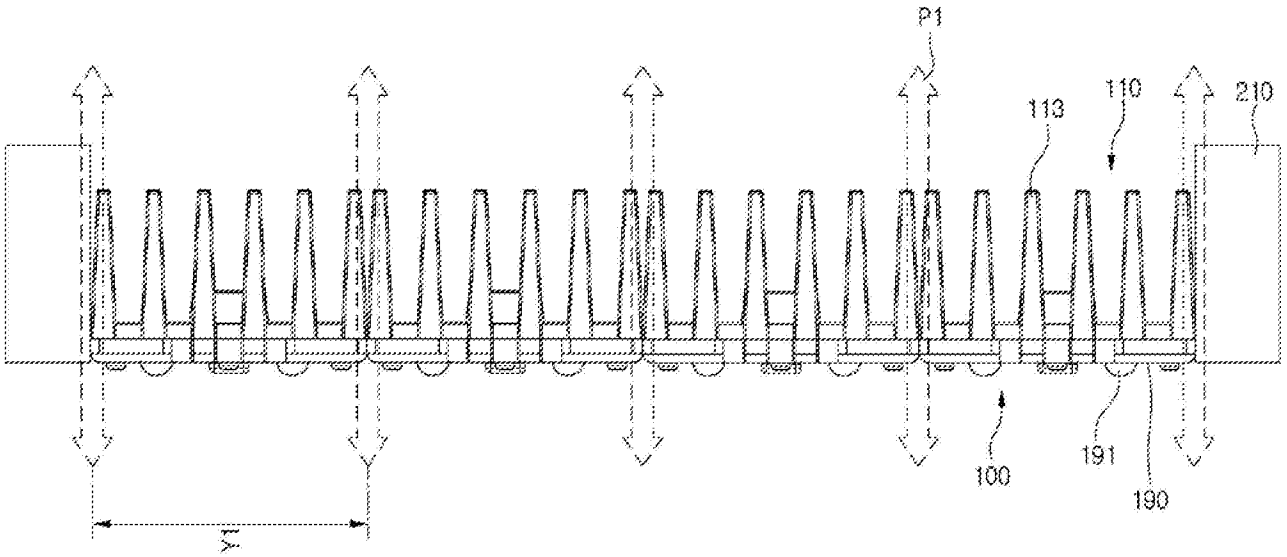

【FIG. 20】
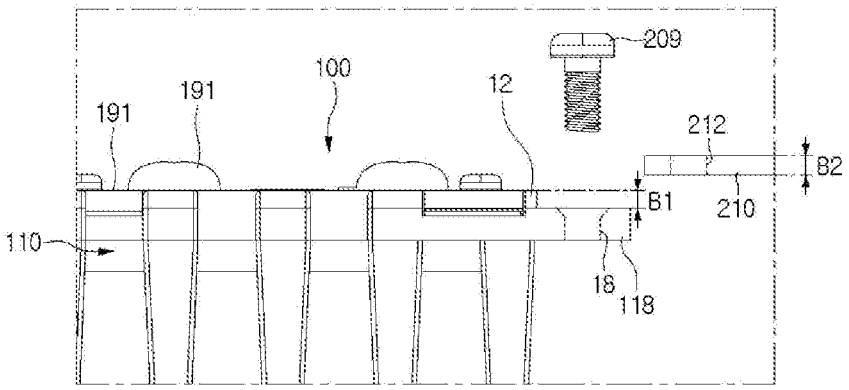
【FIG. 21】
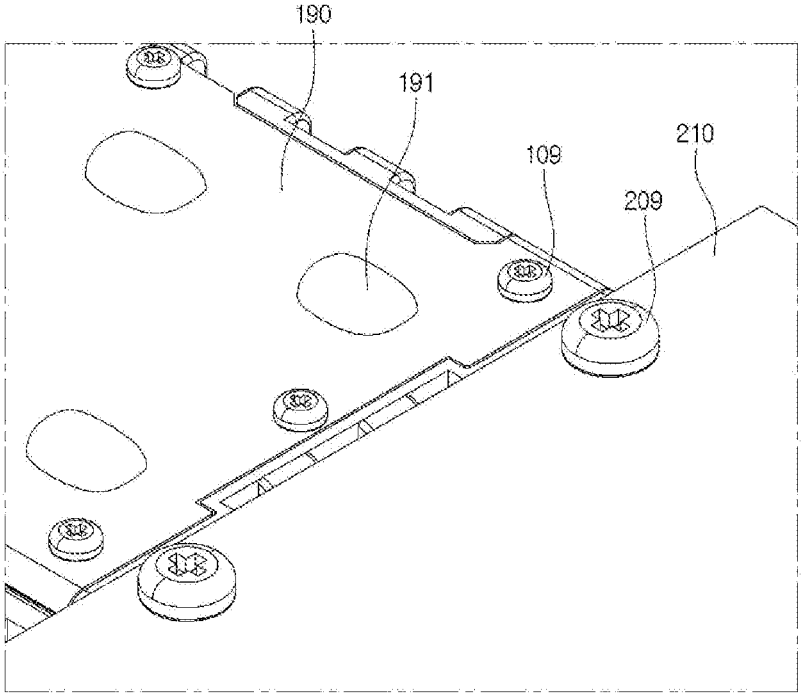

【FIG. 22】
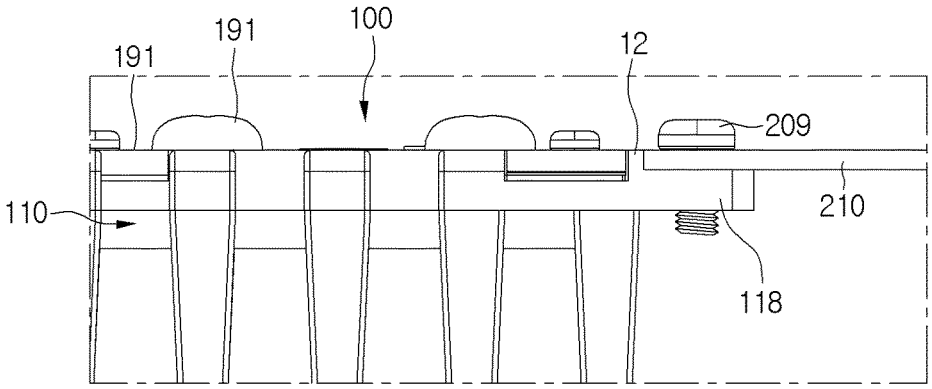
【FIG. 23】
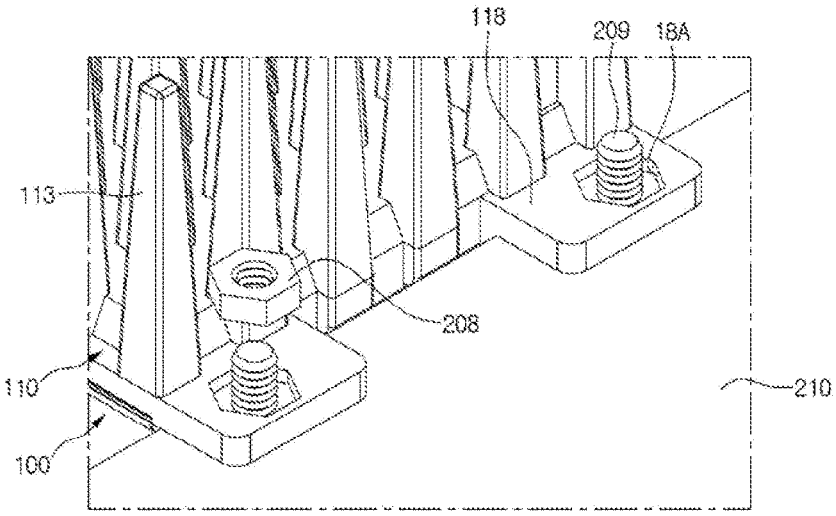

【FIG. 24】
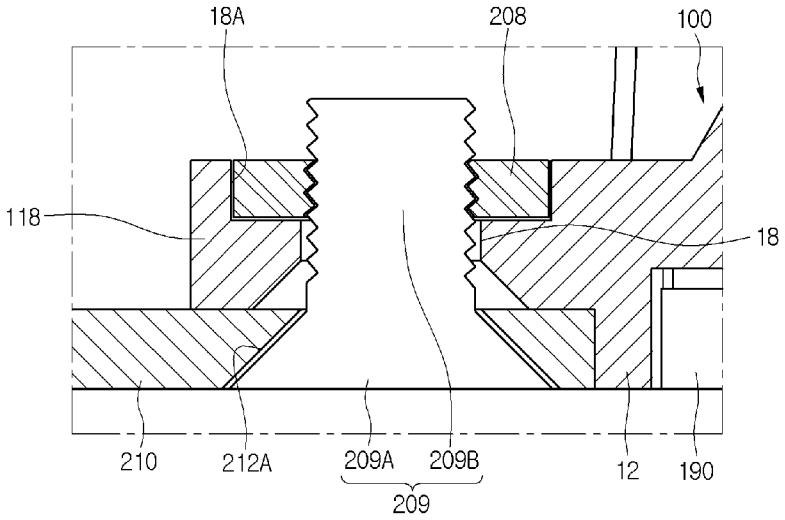

【FIG. 25】
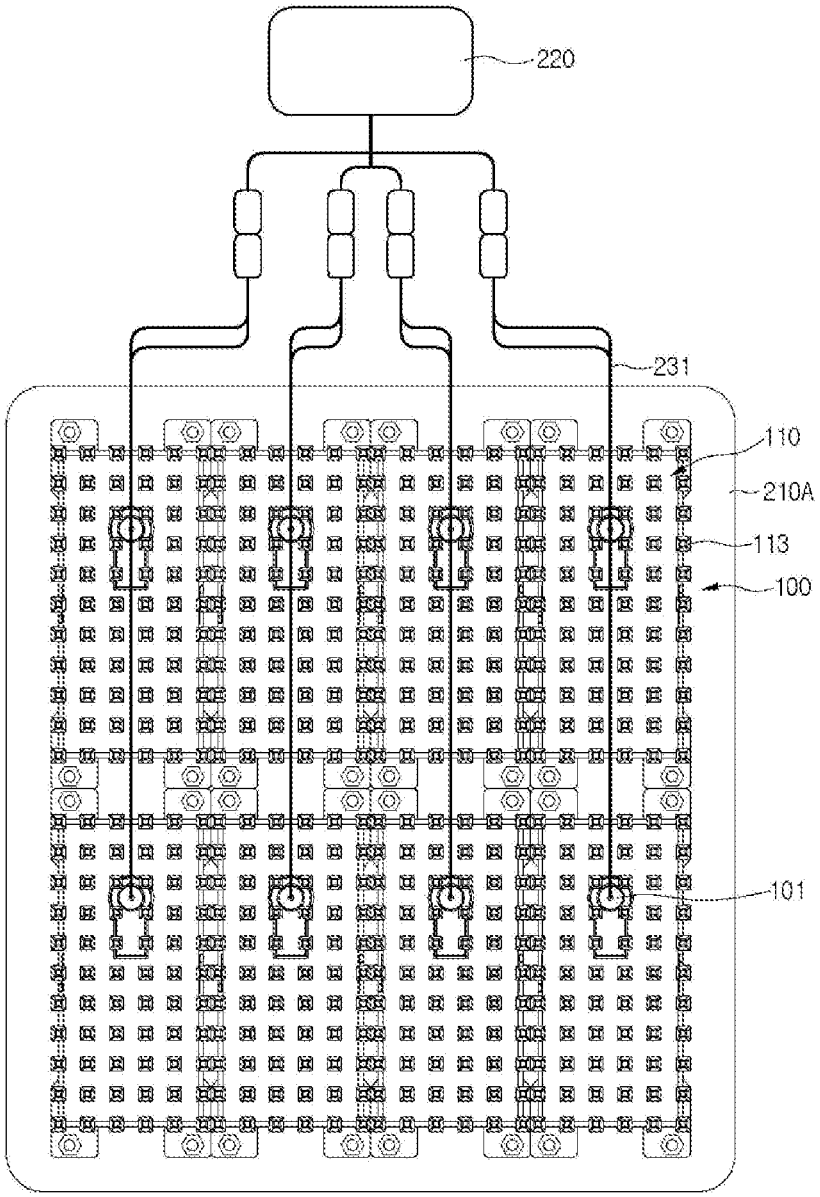

LIGHTING MODULE AND LIGHTING APPARATUS INCLUDING SAME

CROSS REFERENCE TO RELATED APPLICATIONS

This application is the National Phase of PCT International Application No. PCT/KR2015/003335, filed on Apr. 2, 2015, which claims priority under 35 U.S.C. 119(a) to Patent Application No. 10-2014-0040513, filed in Republic of Korea on Apr. 4, 2014, to Patent Application No. 10-2014-0040514, filed in Republic of Korea on Apr. 4, 2014, to Patent Application No. 10-2014-0040515, filed in Republic of Korea on Apr. 4, 2014, and to Patent Application No. 10-2014-0040783, filed in Republic of Korea on Apr. 4, 2014 all of which are hereby expressly incorporated by reference into the present application.

TECHNICAL FIELD

Embodiments relate to a lighting module and a lighting apparatus including the same.

BACKGROUND ART

In general, when a lighting apparatus using a light emitting diode (LED) is turned on, heat is generated. By this heat, a lamp chamber is heated, decreasing the lifespan of a lamp and various parts thereof. For example, in order to prevent failure from occurring due to overheating of a streetlamp, the streetlamp is turned off at a predetermined temperature or more. However, when the streetlamp is turned off, the function of the street lamp is not performed.

In particular, recently, when a streetlamp is made of a light emitting diode (LED) which has been spotlighted as a high-efficiency light source, a heat dissipating structure for efficiently dissipating heat generated in an LED needs to be improved.

In addition, since a streetlamp made of an LED includes a lampshade having a round shape similarly to an existing streetlamp such as a mercury lamp or a sodium lamp, it is difficult to dissipate heat. In addition, the streetlamp is provided without considering optical properties of a place where the streetlamp is provided, such as a light distribution property, illuminance, and a degree of uniformity. There is a need for a new lighting apparatus using an LED, which is capable of solving such problems.

In addition, when an outdoor apparatus such as a streetlamp is not waterproofed, short circuit may occur. Therefore, there is a need for development of a safe lighting apparatus using an LED, in which water leak is not caused even under bad conditions.

DISCLOSURE

Technical Problem

Embodiments provide a lighting module having a new waterproof heat dissipating structure.

Embodiments provide a lighting module for improving heat dissipating efficiency by disposing a heat dissipating pad between a heat dissipating plate and a printed circuit board.

Embodiments provide a lighting module capable of preventing water from permeating into a light emitting module by disposing a waterproof frame on a periphery of the light emitting module.

Embodiments provide a lighting module capable of preventing water from permeating into a printed circuit board by providing a waterproof projection on a waterproof frame and pressurizing the waterproof projection into a heat dissipating plate and a lens cover.

Embodiments provide a lighting module having a heat dissipating flow passage outside a heat dissipating plate and a lighting apparatus including the same.

Embodiments provide a lighting apparatus having a plurality of lighting modules arranged therein.

Embodiments provide a lighting apparatus capable of removing interference due to a coupling means coupled between a case and a lighting module.

Technical Solution

A lighting module according to an embodiment includes a heat dissipating plate including a plurality of heat dissipating fins disposed thereunder; a light emitting module including a printed circuit board disposed on the heat dissipating plate and a plurality of light emitting devices disposed on the printed circuit board; a lens cover having lens parts disposed on the light emitting devices and provided on the printed circuit board; and a waterproof frame disposed between the heat dissipating plate and the lens cover. The waterproof frame includes first waterproof projections projecting toward a lower surface of the lens cover and second waterproof projections projecting toward an upper surface of the heat dissipating plate.

A lighting module according to an embodiment includes a heat dissipating plate including a heat dissipating body having a receiving region at an upper portion thereof and a plurality of heat dissipating fins disposed under the heat dissipating body; a light emitting module disposed in the receiving region of the heat dissipating plate and including a printed circuit board and a plurality of light emitting devices disposed on the printed circuit board; and a lens cover disposed on the light emitting module and having a plurality of lens parts corresponding to the light emitting devices. The heat dissipating plate includes a plurality of projections projecting from opposite side surfaces among the side surfaces of the heat dissipating body and gaps disposed between the plurality of projections disposed on the side surfaces.

A lighting module according to an embodiment includes a heat dissipating plate including a heat dissipating body, a first groove located at a position lower than an upper portion of the heat dissipating body and a plurality of heat dissipating fins disposed under the heat dissipating body; a light emitting module including a printed circuit board disposed on the heat dissipating plate and a plurality of light emitting devices disposed on the printed circuit board; a lens cover disposed on the light emitting module and coupled to an upper periphery of the heat dissipating plate; a cable disposed in the first groove of the heat dissipating plate; a waterproof cap having a cable hole, in which the cable is disposed, and coupled between the cable and the first groove; and a first ring projection projecting from a surface of the waterproof cap.

A lighting apparatus according to an embodiment includes a heat dissipating plate including a heat dissipating body and a plurality of heat dissipating fins disposed under the heat dissipating body; a light emitting module including a printed circuit board disposed on the heat dissipating plate and a plurality of light emitting devices disposed on the printed circuit board; at least one lighting module having a lens cover having a plurality of lens parts corresponding to the light emitting devices on the light emitting modules; and a case coupled to an outside of the at least one lighting module. The heat dissipating plate includes a first guide rib disposed outside the printed circuit board; a plurality of second guide ribs disposed outside the first guide rib; and a case coupler projecting from opposite side surfaces of the heat dissipating body. The case coupler is located at a position lower than upper ends of the second guide ribs, is coupled with a portion of the case is coupled to the case coupler, and has a thickness enough not to project from the upper ends of the second guide ribs.

Advantageous Effects

Embodiments can improve heat dissipating efficiency by disposing a heat dissipating plate and a heat dissipating pad below a light emitting module.

Embodiments can improve heat dissipating efficiency by closely attaching the entire area of a printed circuit board to a heat dissipating pad.

Embodiments can suppress liquid from permeating using a heat dissipating frame provided with elastic force between a lens cover and a heat dissipating plate in an outer region of a light emitting module.

Embodiments can improve light dissipation efficiency by providing a heat dissipating flow passage outside a lighting module.

Embodiments may not have influence on light distribution by arranging rows of light emitting devices of a plurality of lighting modules at the same interval.

Embodiments can prevent interference upon coupling a lighting module and a case.

Embodiments can improve reliability of a lighting module and a lighting apparatus.

DESCRIPTION OF DRAWINGS

FIG. 1 is an exploded perspective view of a lighting module according to an embodiment.

FIG. 2 is a perspective view showing a heat dissipating plate of the lighting module of FIG. 1.

FIG. 3 is an exploded perspective view of the heat dissipating plate and a heat dissipating cap of the lighting module of FIG. 1.

FIG. 4 is a cross-sectional view of a coupling portion of the heat dissipating plate and the heat dissipating cap of FIG. 3.

FIG. 5 is a side cross-sectional view of the heat dissipating cap of FIG. 3.

FIG. 6*a* is a perspective view of a waterproof frame of the lighting module of FIG. 1.

FIG. 6*b* is a partial cross-sectional view of the waterproof frame of the lighting module of FIG. 1.

FIG. 7 is a diagram showing a light emitting module and a lens cover of the lighting module of FIG. 1.

FIG. 8 is an exploded perspective view of the heat dissipating plate coupled with the light emitting module of the lighting module of FIG. 1 and the lens cover.

FIG. 9 is a perspective view showing a lower surface of the lens cover of the lighting module of FIG. 1.

FIG. 10 is an assembled perspective view of the lighting module of FIG. 1.

FIG. 11 is a side cross-sectional view of the lighting module of FIG. 9.

FIG. 12 is a partial side cross-sectional view of the lighting module of FIG. 9.

FIG. 13 is a plan view of the lighting module of FIG. 10.

FIG. 14 is a bottom view of the lighting module of FIG. 9.

FIG. 15 is a side view of the lighting module of FIG. 9.

FIG. 16 is another side view of the lighting module of FIG. 9.

FIG. 17 is a diagram showing a lighting apparatus having the lighting modules of FIG. 9 arranged in a row.

FIG. 18 is a diagram showing an example of a lighting apparatus having a plurality of lighting modules shown in FIG. 9.

FIG. 19 is a diagram showing an air flow passage of the lighting apparatus of FIG. 18.

FIG. 20 is an exploded diagram of the lighting module and the case in the lighting apparatus according to an embodiment.

FIG. 21 is a perspective view of the lighting apparatus of FIG. 20.

FIG. 22 is a side view of the lighting apparatus of FIG. 21.

FIG. 23 is a diagram showing another example of coupling a case and a lighting module in the lighting apparatus of FIG. 22.

FIG. 24 is a side cross-sectional view of the lighting apparatus of FIG. 23.

FIG. 25 is a diagram showing a lighting apparatus in which the lighting modules of FIG. 10 are arranged in two rows.

BEST MODE

Hereinafter, a lighting module or a lighting apparatus having a heat dissipating structure according to an embodiment will be described in detail with reference to the accompanying drawings. The following terms are defined in consideration of the function of the present embodiment and may be changed depending on user's or operator's intention or customs. Therefore, the terms may be defined based on the description of the present specification. In addition, the following embodiments are merely exemplary and do not limit the scope of the present invention and various embodiments may be embodied through this technical spirit.

Hereinafter, the preferred embodiments of the present invention will be described in greater detail with reference to the accompanying drawings. The term "lighting module" or "lighting apparatus" used in the present specification is an outdoor lighting apparatus and includes a streetlamp, various lamps, an electronic display board and a headlight.

FIG. 1 is an exploded perspective view of a lighting module according to an embodiment, FIG. 2 is a perspective view showing a heat dissipating plate of the lighting module of FIG. 1, FIG. 3 is an exploded perspective view of the heat dissipating plate and a heat dissipating cap of the lighting module of FIG. 1, FIG. 4 is a cross-sectional view of a coupling portion of the heat dissipating plate and the heat dissipating cap of FIG. 3, FIG. 5 is a side cross-sectional view of the heat dissipating cap of FIG. 3, FIGS. 6*a* and 6*b* are diagrams showing a waterproof frame of the lighting module of FIG. 1, FIG. 7 is a diagram showing a light emitting module and a lens cover of the lighting module of FIG. 1, FIG. 8 is an exploded perspective view of the heat dissipating plate coupled with the light emitting module of the lighting module of FIG. 1 and the lens cover, FIG. 9 is a perspective view showing a lower surface of the lens cover of the lighting module of FIG. 1, FIG. 10 is an assembled perspective view of the lighting module of FIG. 1, FIG. 11 is a side cross-sectional view of the lighting module of FIG. 9, FIG. 12 is a partial side cross-sectional view of the lighting module of FIG. 9, FIG. 13 is a plan view of the lighting module of FIG. 10, FIG. 14 is a bottom view of the lighting module of FIG. 9, and FIGS. 15 and 16 are side views of the lighting module of FIG. 9.

Referring to FIGS. 1 to 16, the lighting module 100 may include a heat dissipating plate 110, a waterproof frame 140 coupled to the upper periphery of the heat dissipating plate 110, a light emitting module 170 having a printed circuit board 171 and a light emitting device 173 on the heat dissipating plate 110 and a lens cover 190 provided on the light emitting module 170.

The lighting module 100 may include a heat dissipating pad 160 disposed between the heat dissipating plate 110 and the printed circuit board 171.

The lighting module 100 includes a waterproof cap 105 having a cable hole and coupled to a portion of the heat dissipating plate 110.

The heat dissipating plate 110 may be made of a metal material. The heat dissipating plate 110 may include a plurality of heat dissipating fins 113. The heat dissipating plate 110 may include a receiving region 112 in which the printed circuit board 171 is coupled. The heat dissipating pad 160 and the printed circuit board 171 may be disposed in the receiving region 112. The heat dissipating plate 110 may include a plurality of case couplers 118 and 119 coupled to the case.

The heat dissipating plate 110 includes a heat dissipating body 111, the plurality of heat dissipating fins 113 projecting from the heat dissipating body 111, the receiving region 112, in which the light emitting module 170 is received on the heat dissipating body 111, and the plurality of case couplers 118 and 119 disposed at the outer portion of the heat dissipating body 111.

As shown in FIG. 2, the length X1 of the heat dissipating plate 110 in a first direction X may be greater than the width Y1 of the heat dissipating plate 110 in a second direction Y. The first direction X is a longitudinal direction and may be perpendicular to the second direction Y. The length X1 of the heat dissipating plate 110 may be twice or more the width Y1. For example, the length X1 may be twice to four times the width Y1.

The receiving region 112 of the heat dissipating plate 110 is provided at a predetermined depth from an outer periphery region. The heat dissipating pad 160 and the printed circuit board 171 are disposed in the receiving region 112. The bottom of the receiving region 112 may be flat. The bottom of the receiving region 112 of the heat dissipating plate 110 is flat and thus may be in surface contact with the lower surface of the heat dissipating pad 160. Heat transferred from the heat dissipating pad 160 may be dissipated to the heat dissipating fin 113 through the heat dissipating body 111.

The plurality of heat dissipating fins 113 may be arranged at a predetermined interval in a direction vertical to the heat dissipating plate 110, e.g., the heat dissipating body 111. The heat dissipating fins 113 may be arranged in a dot type matrix or a lattice shape, for example, as shown in FIG. 14, when viewed from the bottom. The plurality of heat dissipating fins 113 may be arranged in a regular interval or an irregular interval. Assume that the heat dissipating fins 113 are arranged at a constant interval for uniform heat dissipating. Here, the cable 101 may be freely drawn between the plurality of heat dissipating fins 113 in an X-axis direction or a Y-axis direction. Each heat dissipating fin 113 may have a pillar shape, e.g., a polygonal pillar shape or a cylindrical pillar shape.

The plurality of heat dissipating fins 113 may be formed such that the thickness D6 or the width thereof is gradually reduced from the heat dissipating body 111, as shown in FIGS. 15 and 16, without being limited thereto.

The heat dissipating body 111 includes a first guide rib 11 disposed on the periphery of the receiving region 112 and second guide ribs 12, 13, 14 and 15 disposed the outside the first guide rib 11.

The first guide rib 11 may project from the horizontal bottom of the receiving region 112 by a predetermined height at the periphery of the receiving region 112. The first guide rib 11 may be formed in a continuously connected ring shape, for example. The first guide rib 11 includes a plurality of convex portions 11A and concave portions 11B. The plurality of convex portions 11A is arranged along the periphery of the receiving region 112 and convexly projects toward the center of the receiving region 112. The concave portions 11B are disposed between the convex portions 11A. Each convex portion 11A may provide a space for a coupler 121 for coupling of the coupling means.

In the receiving region 112, the heat dissipating pad 160 and the printed circuit board 171 of the light emitting module 170 are coupled. The first guide rib 11 is disposed to correspond to the side surfaces of the heat dissipating pad 160 and the printed circuit board 171. The first guide rib 11 may be disposed between the printed circuit board 171 and the waterproof frame 140. In addition, the first guide rib 11 may selectively contact the side surfaces of the printed circuit board 171. The convex parts 11*a* and the concave parts 11*b* of the first guide rib 11 can prevent the heat dissipating pad 160 and the printed circuit board 171 from being rotated or detached and can be coupled with the components coupled in the receiving region 112.

The height of the upper end of the first guide rib 11 may be higher than that of the upper surface of the printed circuit board 171. The first guide rib 11 may press the printed circuit board 171 toward the heat dissipating plate 110 upon coupling of the second coupling means 109.

As shown in FIGS. 2 and 8, the second guide ribs 12, 13, 14 and 15 may be disposed outside the first guide rib 11. The second guide ribs 12, 13, 14 and 15 may be disposed outside the waterproof frame 140 and the lens cover 190. The second guide ribs 12, 13, 14 and 15 guide the waterproof frame 140 and the lens cover 190. The second guide ribs 12, 13, 14 and 15 include a plurality of ribs spaced apart from one another. The second guide ribs 12, 13, 14 and 15 include first and second ribs 12 and 13 facing each other at both sides of a first direction X of the heat dissipating body 111 and third and fourth ribs 14 and 15 facing each other at both sides of a second direction Y of the heat dissipating body 111. Each of the first and second ribs 12 and 13 has the same straight length as the width Y1 of the heat dissipating body 111 in the second direction Y and covers the outside of the waterproof frame 140 and the lens cover 190. Each of the third and fourth ribs 14 and 15 may have a length less than the length X1 of the heat dissipating body 111 in the first direction. For example, each of the third and fourth ribs 14 and 15 may have a length which is equal to or less than ½ the length X1 of the heat dissipating body 111 in the first direction. A plurality of third ribs 14 and a plurality of fourth ribs 15 may be disposed.

The case couplers 118 and 119 are formed outside the first and second ribs 12 and 13 at opposite sides of each other, respectively. For example, a plurality of first case couplers 118 is disposed outside the first rib 12 and a plurality of second case couplers 119 is disposed outside the second rib 13. The first and second case couplers 118 and 119 are formed at a position lower than those of the upper ends of the first and second ribs 12 and 13 in a stepped structure. The first and second case couplers 118 and 119 project from opposite side surfaces of the heat dissipating body 111.

The waterproof frame 140 may be coupled to the upper periphery of the heat dissipating plate 110. The waterproof frame 140 may be coupled to a region between the first guide rib 11 and the second guide ribs 12, 13, 14 and 15. The waterproof frame 140 may be disposed between the heat dissipating plate 110 and the lens cover 190.

The heat dissipating plate 110 may include a plurality of cover couplers 121. The plurality of cover couplers 121 may be disposed in different regions among the regions between the first guide rib 11 and the second guide ribs 12, 13, 14 and 15. The plurality of cover couplers 121 may be regions recessed from the upper ends of the first guide rib 11 and the second guide ribs 12, 13, 14 and 15. The plurality of cover couplers 121 may have coupling holes 12A formed therein. The coupling holes 12A of the cover couplers 121 may be disposed at positions corresponding to the coupling holes 42 of the waterproof frame 140 and the coupling holes 99 of the outer part of the lens cover 190 and the second coupling means 109 may be coupled to the coupling holes 42 and 99. The second coupling means 109 includes a member such as a screw or a rivet.

As shown in FIGS. 2, 3 and 11, the waterproof cap 105 may be coupled in the receiving region 112 of the heat dissipating body 111. The waterproof cap 105 may have a cable hole 106 and may be coupled to a first groove 114 of the heat dissipating plate 110. The receiving region 112 may include a first groove 114 and a second groove 115. The first groove 114 is coupled with the waterproof cap 105 and the second groove 115 may be coupled with the first groove 114 and have a second connector 107 disposed therein. The waterproof cap 105 may be coupled to the periphery of the cable 101. The first groove 114 and the second groove 115 may be disposed in a region lower than the bottom of the heat dissipating body 111 or the bottom of the receiving region 112. The first groove 114 and the second groove 115 are disposed inside the heat dissipating body 111 and are disposed in a concave shape in the bottom of the receiving region 112. The first groove 114 may be disposed in a stepped structure in which the width of the upper portion thereof is greater than that of the lower portion thereof. The structure of the first groove 114 may provide a long water permeation path.

The waterproof cap 105 is made of a rubber material and may be coupled to the first groove 114. The waterproof cap 105 includes a first waterproof structure 51 and a second waterproof structure 52 as shown in FIG. 5 and each of the first waterproof structure 51 and the second waterproof structure 52 may include a stepped structure in which the widths of the upper and lower portions are different. For example, in the waterproof cap 105, the width C1 of the upper portion of the first waterproof structure 51 is greater than the width D2 of the lower portion of the second waterproof structure 52. The first groove 114 may have a structure in which the waterproof cap 105 may be inserted. The width C1 of the first waterproof structure 51 of the waterproof cap 105 may be gradually decreased in the low direction and the width C2 of the second waterproof structure 52 may be gradually increased in the upper direction. Here, since the lower periphery of the second waterproof structure 52 is spaced apart from the lower periphery of the first waterproof structure 51 by a predetermined distance C3, an outer region between the second waterproof structure 52 and the first waterproof structure 51 may be provided in a stepped structure. As shown in FIGS. 3 and 4, the waterproof cap 105 may be inserted into and coupled to the first groove 114. A through-hole 114A formed in the heat dissipating plate 110 may be formed in the lower portion of the first groove 114 and the second waterproof structure 52 of the waterproof cap 105 is coupled to the hole 114A. The lower surface of the waterproof cap 105 may be exposed to the lower surface of the heat dissipating plate 110.

Here, at least one of the outer surface of the waterproof cap 105 or the surface of the first groove 114 may include a projection or groove structure in order to prevent water permeation. For example, the waterproof cap 105 may include one or a plurality of ring projections 5 and 6. The ring projections 5 and 6 may be disposed on at least one of the first waterproof structure 51 and the second waterproof structure 52. The waterproof cap 106 may include the first ring projections 5 on the surface of the first waterproof structure 51 and the second ring projections 6 on the surface of the second waterproof structure 52, for example.

The first ring projections 5 are formed in a ring shape having different external diameters and the second ring projections 6 are formed in a ring shape having different external diameters, which are less than the external diameters of the first ring projections 5. The first and second ring projections 5 and 6 may closely contact the surface of the first groove 114 with predetermined elastic force. The first ring projections 5 of the first waterproof structure 51 may have external diameters greater than those of the second ring projections 6 of the second waterproof structure 52.

The cable 101 is disposed in the first groove 114. A cable hole 106 is provided in the center region of the waterproof cap 105 and third ring projections 7 may be provided on the surface of the cable hole 106. The third ring projections 7 may be formed of a plurality of rings having the same internal diameter. The plurality of third ring projections 7 may be arranged in a vertical direction and closely contact the surface of the cable 101 with elastic force. The waterproof cap 105 can prevent water from permeating through the cable hole 106 and the first groove 114.

The waterproof cap 105 may include a guide groove 106A connected to the cable hole 106. In the waterproof cap 105, the guide groove 106A may be connected to the second groove 115. When the cable 101 is inserted into the cable hole 106 of the waterproof cap 105, the cable 101 may be bent along the guide groove 106A and may be connected to the second connector 107 provided in the second groove 115. The second groove 115 may be formed at a depth less than that of the first groove 114 having the hole 114A. The second groove 115 may be formed in a concave shape and does not penetrate the heat dissipating plate 110.

The waterproof cap 105 includes a hooked projection 106B and the heat dissipating plate 11 may include a hooked step 114B adjacent to the first groove 114. The hooked projection 106B may be coupled to the hooked step 106B in order to prevent rotation. The hooked projection 106B projects from the waterproof cap 105 toward the second groove 115. The hooked projection 106B projects from the first waterproof structure 51 toward the second groove 115. The hooked projection 106B may be locked by the hooked step 114B extending between the first groove 114 and the second groove 115 to prevent the waterproof cap 105 from rotating. The hooked step 114B may project from the heat dissipating body 111 to a region between the first groove 114 and the second groove 115.

As shown in FIGS. 1 and 6*b*, the waterproof frame 140 may be coupled to the heat dissipating plate 110. The waterproof frame 140 may include a pad hole 141 formed therein. The pad hole 141 has an area equal to or greater than the size of the heat dissipating pad 160. The heat dissipating pad 160 may be inserted through the pad hole 141.

The waterproof frame 140 includes a projection part 41A projecting toward the center of the pad hole 141 and a concave part 41B located outside the projection part 41A. The projection part 41A and the concave part 41B may be arranged along the first guide rib 11 of the heat dissipating plate 110. Here, the heat dissipating pad 160 is disposed in the receiving region 112 of the heat dissipating plate 110 through the pad hole 141 and the first guide rib 11 is disposed in a region between the heat dissipating pad 160 and the waterproof frame 140.

As shown in FIGS. 1, 6*a* and 6*b*, the waterproof frame 140 may include waterproof projections 145 and 146. The waterproof projections 145 and 146 may be provided in a region between the first guide rib 11 and the second guide ribs 12, 13, 14 and 15. The waterproof projections 145 and 146 include the first waterproof projection 145 projecting from the water frame 140 toward the lower surface of the lens cover 190 and the second waterproof projection 145 projecting toward the upper surface of the heat dissipating plate 110. The first and second waterproof projections 145 and 146 may project in opposite directions. Since the first and second waterproof projections 145 and 146 are provided to overlap each other in the vertical direction, waterproofing effects can be maximized. Each of the first and second waterproof projections 145 and 146 may be formed in a single waterproof structure or a double waterproof structure according to the number of waterproof projections. For example, when the number of waterproof projections is two or three, the first and second waterproof projections may be formed in a double waterproof structure. At least one or both of the first and second waterproof projections 145 and 146 may be formed in a continuous ring structure along the periphery of the first guide rib 11. The first and second waterproof projections 145 and 146 may contact the lens cover 18 and the heat dissipating plate 110. The first and second waterproof projections 145 and 146 may provide elastic force and repulsive force to an interface between the lens cover 190 and the heat dissipating plate 110 to efficiently perform waterproofing, when the lens cover 190 is coupled.

As shown in FIGS. 11 and 12, the lower surface of the lens cover 190 and the upper surface of the heat dissipating plate 110 may be in contact with each other. Since the lens cover 190 and the heat dissipating plate 110 are in contact with each other, it is possible to suppress water permeation through the outer interface.

Referring to FIGS. 1, 7 and 8, the waterproof frame 140 includes a plurality of cover couplers 142 at the outer periphery thereof. Each cover coupler 142 may include coupling holes 42 for coupling of the coupling means.

The cover couplers 142 of the waterproof frame 140 are provided at a position corresponding to the cover couplers 121 of the heat dissipating plate 110. When the lens cover 190 is coupled by the second coupling means 109, the waterproof frame 140 is coupled in a state of being closely adhered to the heat dissipating plate 110. The waterproof frame 140 can suppress water from permeating through an interface between the waterproof frame 140 and the heat dissipating plate 110. In addition, it is possible to prevent water from permeating using the first and second waterproof projections 145 and 146 provided on the upper and lower surfaces of the waterproof frame 140.

As another example, the waterproof projections 145 and 146 are not provided on the waterproof frame 140 but are provided on the upper surface of the heat dissipating plate 110 and the lower surface of the lens cover 190. The waterproof projections provided on the upper surface of the heat dissipating plate 110 and the lower surface of the lens cover 190 can press the upper and lower surfaces of the waterproof frame 140 to prevent water permeation. As another example, waterproof rings may be provided on the upper surface of the waterproof frame 140 and the lower surface of the lens cover 190 to be inserted between the first and second waterproof projections 145 and 146 of the waterproof frame 140.

As another example, the first waterproof projection 145 may be provided on at least one of the upper surface of the waterproof frame 140 and the lower surface of the lens cover 190 and the second waterproof projection 146 may be formed on at least one of the heat dissipating plate 110 and the lower surface of the waterproof frame 140.

As shown in FIGS. 1 and 11, the heat dissipating pad 160 is disposed between the heat dissipating plate 110 and the printed circuit board 171. The heat dissipating pad 160 is inserted in the receiving region 112 of the heat dissipating plate 110. The heat dissipating pad 160 may include a resin material, for example, a silicon material. Since the heat dissipating pad 160 is made of a compressible elastic material, the contact area with the printed circuit board 171 may increase upon pressurization. Therefore, heat from the printed circuit board 171 is uniformly transferred to the heat dissipating plate 110. The thickness of the heat dissipating pad 160 may be less than that of the printed circuit board 171. The area of the lower surface of the heat dissipating pad 160 may be equal to or less than that of the lower surface of the printed circuit board 171.

A connector hole 162 and a coupling hole 163 may be formed in the heat dissipating pad 160 and the second connector 107 connected to the cable 101 may be inserted into the connector hole 162.

As shown in FIGS. 1 and 7, the light emitting module 170 includes the printed circuit board 171 and one or more light emitting devices 173. The printed circuit board 171 includes at least one of a resin material PCB, a metal core PCB (MCPCB) and a flexible PCB (FPCB). For example, the metal core PCB may be provided for heat dissipating and the metal core PCB may include a circuit pattern layer formed at an upper portion thereof, a metal layer formed at a lower portion thereof and an insulation layer formed between the metal layer and the circuit pattern layer. When the thickness of the metal layer is set to 70% or more that of the printed circuit board 171, it is possible to improve heat dissipating efficiency. An AC module may be provided on the printed circuit board 171 and may be selectively used in an AC or DC power mode.

The printed circuit board 171 is disposed between the lens cover 190 and the heat dissipating pad 160. The printed circuit board 171 contacts the lens cover 190 and the heat dissipating pad 160. As shown in FIGS. 2 and 7, the outer periphery of the printed circuit board 171 corresponds to the first guide rib 11 of the heat dissipating plate 110. The printed circuit board 171 includes a plurality of recesses 71, 72, 73 and 74 and the plurality of recesses 71, 72, 73 and 74 may be provided at the outer periphery of the printed circuit board 171. The plurality of recesses 71, 72, 73 and 74 may be concavely provided in the center direction of the printed circuit board 171. The regions of the recesses 71, 72, 73 and 74 may correspond to the cover couplers 121 of the heat dissipating plate 110.

The first connector 175 may be coupled to the printed circuit board 171. The first connector 175 may be coupled to at least one of the upper and lower surfaces of the printed circuit board 171. For example, the first connector 175 passes through the connector hole of the printed circuit board 171 to be connected to the circuit pattern on the upper surface of the printed circuit board 171. The first connector 175 may be electrically connected to the second connector 107.

The center region of the printed circuit board 171 may include a coupling hole 79. The first coupling means 108 may be coupled to the heat dissipating plate 11 through the coupling hole 79 of the printed circuit board 171 and the coupling hole 163 of the heat dissipating pad 160. Therefore, movement of the center of the printed circuit board 171 can be prevented and the contact area with the heat dissipating pad 160 can be improved. The printed circuit board 171 can be fixed using one first coupling means 108, that is, a minimum number of first coupling means.

One or more, for example, a plurality of light emitting devices 173 may be arranged in a dot shape. The plurality of light emitting devices 173 may be arranged in one or more rows, for example, two or more rows. Here, each row of the light emitting devices 173 may be formed in the longitudinal direction X of the heat dissipating plate 110.

The light emitting device 173 is a package having a light emitting chip and may include an optical lens. The light emitting chip may emit at least one of blue, red, green and UV (ultraviolet) light. The light emitting device 173 may emit at least one of white, blue, red and green light and may emit white light for illumination, for example.

A first distance D1 between the rows of the light emitting device 173 may be greater than a second distance D2 between the light emitting devices 173 of each row, without being limited thereto. The first distance D1 between the rows of the light emitting devices 173 may be equal to the distance between the rows of the lens part 191 of the lens cover 190 and the second distance D2 between the light emitting device 173 may be equal to the distance between the lens parts 191 of each row.

As shown in FIGS. 1, 7 and 8, the lens cover 190 may include a plurality of lens parts 191. Each lens part 191 may be provided to cover each light emitting device 173 or two or more light emitting devices 173. Each lens part 191 may have a semispherical shape. The length of each lens part 191 in the first direction X is greater than the width of each lens part in the second direction Y, thereby differently providing beam angle distribution of light.

The lens cover 190 may include at least one of a transparent resin material such as a silicon or epoxy material, an acrylic resin such as glass or polymethyl methacrylate (PMMA), polyethylene terephthalate (PET), polycarbonate (PC), cycloolefin copolymer (COP) and polyethylene naphthalate (PEN) resin. The lens part 191 may be integrally formed of the same material as the lens cover 190 or may be formed of a material different from that of the lens cover 190. If different materials are used, the lens part 191 may be formed of a transparent resin material and the lens cover 190 may be formed of a reflective material.

The cover coupler 194 may be disposed at the periphery of the lens cover 190 and the coupling hole 99 may be formed in the cover coupler 194. The second coupling means 109 may be coupled through the coupling hole 42 of the waterproof frame 140 and the coupling hole 12A of the heat dissipating plate 110.

The lens cover 190 includes a first receiving part 192 and a second receiving part 193. The first receiving part 192 projects for the first connector 175 of the printed circuit board 171 and the second receiving part 193 projects for the first coupling means 108 coupled to the printed circuit board 171. The first and second receiving parts 192 and 193 may have different heights.

The heat dissipating pad 160 and the light emitting module 170 are laminated in the receiving region 112 of the heat dissipating plate 110 according to the embodiment and may be coupled by the first coupling means 108. The waterproof frame 140 is coupled to the periphery of the receiving region 112, the lens cover 190 is coupled to the light emitting module 170 and the waterproof frame 140, and the second coupling means 109 fastens the lens cover 190 to the heat dissipating plate 110. Thus, the lighting module 100 shown in FIG. 10 can be obtained.

As shown in FIG. 8, an identification portion 195 may be provided at some of the corners of the lens cover 190. The identification part 195 may be coupled to an identification projection 117 of the heat dissipating plate 110 with directivity.

The thickness of the cover coupler 194 of the lens cover 190 may be greater than that of the lens cover 190, as shown in FIG. 12. When the second coupling means 109 is coupled to the cover coupler 194, it is possible to efficiently pressurize the cover coupler 142 of the waterproof frame 140.

The lighting module 100 can prevent water from permeating into the light emitting module 170. The lighting module 100 may be mounted in an outdoor lighting device to improve a portion vulnerable to water.

As shown in FIGS. 7, 9 and 12, lower projections 196 and 197 may be provided on the lower surface of the lens cover 190. The lower projections 196 and 197 may project from the lower surface of the lens cover 190 toward the upper surface of the printed circuit board 171. One or a plurality of lower projections 196 and 197 may be provided. The lower projections 196 and 197 are members for pressurizing the printed circuit board 171 toward the heat dissipating plate 110 and may be formed of the same elastic material as the lens cover 190. The lower projections 196 and 197 may be provided closer to the first and second ribs 12 and 13 of the second guide ribs than the center region of the heat dissipating plate 110.

The plurality of lower projections 196 and 197 may be spaced apart from each other by a predetermined distance X2 in the longitudinal direction of the heat dissipating plate 110. The distance X2 is sufficient to distributively pressurize both sides of the center of the printed circuit board 171 of FIG. 8. The plurality of lower projections 196 and 197 may be spaced apart from each other by 50% or more, for example, 70% or more the length of the printed circuit board 171. At the center between the lower projections 196 and 197, at least one of the second receiving part 193 of the lens cover 190, the coupling hole 79 of the printed circuit board 171 or the second coupling means 109 may be located. Alternatively, the lower projections 196 and 197 may be provided at opposite sides of each other with respect to the second receiving part 193 of the lens cover 190 or the coupling hole 79 of the printed circuit board 171 and may be provided at the same interval as the second receiving part 193 of the lens cover 190 or the coupling hole 79 of the printed circuit board 171. The lower projections 196 and 197 may be provided at opposite sides of each other with respect to the first coupling means 108 and may be provided at the same interval as the first coupling means 108.

The lower projections 196 and 197 pressurize both sides of the printed circuit board 171 toward the heat dissipating plate 110 to closely adhere both sides of the printed circuit board to the heat dissipating pad 160 upon coupling the lens cover 190. The center region of the printed circuit board 171 is coupled by the single first coupling means 108 and both sides of the center may be pressurized by the lower projections 196 and 197. Therefore, the contact area of the printed circuit board 171 and the heat dissipating pad 160 can increase and water permeation can be prevented.

As shown in FIGS. 13 to 15, some pins arranged in the edge region of the heat dissipating plate 110 among the heat dissipating fins 113 of the heat dissipating plate 110 according to the embodiment may be exposed to the outside of the heat dissipating plate 110. For example, as shown in FIG. 14, the heat dissipating fins 113 may be divided into first heat dissipating fins 113A which are not exposed in the top view of the lighting module 100 and second heat dissipating fins 113B which are exposed in the top view. Alternatively, the heat dissipating fins 113 may be divided into first heat dissipating fins 113A having no a gap at an upper end thereof and second heat dissipating fins 113B having a gap at the upper end thereof. As shown in FIGS. 15 and 16, the length A2 of the second heat dissipating fins 113*b* may be greater than the length A1 of the first heat dissipating fins 113A.

As shown in FIG. 13, the heat dissipating plate 110 may provide first heat dissipating flow passages formed between the heat dissipating fins 113 arranged thereunder and second heat dissipating flow passages formed in an external direction. The first heat dissipating flow passages may be arranged such that the heat dissipating fins 113 cross each other in the dot-shaped matrix structure. The heat dissipating plate 110 may include projections 21, 22, 23 and 24 provided on at least two side surfaces or opposite side surfaces thereof. The projections 21, 22, 23 and 24 may extend from the heat dissipating fins 113. Assume that the projections 21, 22, 23 and 24 are provided on the side surfaces of the heat dissipating plate 110. The projections 21, 22, 23 and 24 may be provided in the region of the lighting module 100 or the region of the heat dissipating plate 110.

Regions between the projections 21, 22, 23 and 24 may be second heat dissipating flow passages and the regions of the gaps 21A, 22A, 23A and 24A. The gaps 21A, 22A, 23A and 24A may provide the second heat dissipating flow passages at the side surfaces of the heat dissipating plate 110.

The width D3 of the gaps 21A, 22A, 23A and 24A may be greater than the width D6 of the projections 21, 22, 23 and 24 and the depth D5 of the gaps 21A, 22A, 23A and 24A may be less than the width D6. Here, if the heat dissipating fin 113 has a square pillar shape, the width D6 of the projections 21, 22, 23 and 24 is equal to that of the upper end of the heat dissipating fin 113.

The projections 21, 22, 23 and 24 may include first to fourth projections 21, 22, 23 and 24. The first and second projections 21 and 22 may project from both sides of the longitudinal direction X of the heat dissipating plate 110. The first and second projections 21 and 22 may be provided between the first and second case couplers 118 and 119. The third and fourth projections 23 and 24 may project from both sides of the width direction Y of the heat dissipating plate 110 and may be provided between the cover couplers 194 of the lens cover 190. The number of third projections 23 may be three or more times, for example, four or more times the number of the first projections 21. The number of third projections 23 may be greater than the number of light emitting devices 173 of each row. The numbers of projections provided on two adjacent side surfaces of the heat dissipating plate 110 may be different.

In at least one or all of the first to fourth projections 21, 22, 23 and 24, the distance D4 between adjacent projections may be less than the distance D2 of the light emitting device 173. The distance D4 may be in a range of 1/1.5 to 1/2.5, for example, ½ the distance D2 of the light emitting device 173. The number of heat dissipating fins 113 overlapping the heat dissipating plate 110 in a vertical direction may be 5 or more times, for example, six or more times the total number of light emitting devices 173. Accordingly, it is possible to enhance light dissipation efficiency.

As shown in FIGS. 13 and 14, the number of heat dissipating fins 113 arranged in the longitudinal direction X of the heat dissipating plate 110 may be two or more times the number of the light emitting devices 173 of each row. Accordingly, it is possible to improve heat dissipating efficiency of the heat dissipating plate 110. The numbers of projections provided on adjacent side surfaces of the heat dissipating plate 110 may be different from each other and the numbers of projections provided on opposite side surfaces may be equal to each other. For example, the number of projections 21 and 22 of the first and second side surfaces provided in the longitudinal direction X of the heat dissipating plate 110 may be less than that of projections 23 and 24 of the third and fourth side surfaces provided in the width direction Y, the numbers of projections 21 and 22 of the first and second side surfaces may be equal to each other and the numbers of projections 23 and 24 may be equal to each other.

The projections 21 and 22 and gaps 21A and 22A provided on the first and second side surfaces of the heat dissipating plate 110 may be formed in a range of 30% to 60% of the width Y1 of the heat dissipating plate 110 as a first side heat dissipating region. The projections 23 and 24 and gaps 23A and 24A provided on the third and fourth side surfaces of the heat dissipating plate 110 may be formed in a range of 55% to 90% of the length X1 of the heat dissipating plate as a second side heat dissipating region.

As shown in FIG. 13, each of the second guide ribs 12, 13, 14 and 15 may be connected to two or more of the projections 21, 22, 23 and 24, thereby improving heat dissipating efficiency.

As shown in FIGS. 17 to 19, the lighting module 100 may be defined as a unit module. Two or more unit modules may be provided. For example, when two or more unit modules are arranged in the width direction Y, the unit modules may be in contact with each other.

When the lighting modules 100 are closely arranged in the width direction and are coupled to a portion of the case 210 through the first and second case couplers 118 and 119, both side surfaces of the lighting modules 100 may be in contact with each other. In this case, the projections 23 and 24 provided on the side surfaces of the lighting module 100 may be in contact with the projections 23 and 24 of another lighting module 100. When a plurality of lighting modules 100 is arranged, air may flow through the gaps 21A, 22A, 23A and 24A provided at the side surfaces of the lighting modules 100. The gaps 23A and 24A between the projections 23 and 24 provided in a boundary region 180 between the lighting modules 100 correspond to each other such that the size thereof is doubled. Since air P1 flows through the gaps 23A and 24A as shown in FIG. 19, heat dissipating efficiency can increase. That is, when the lighting modules 100 are mounted in the width direction, efficient heat dissipating may be performed by the gaps 21A, 22A, 23A and 24A provided in the boundary region 180 of the lighting modules 100. In addition, it is possible to make better use of a space of the lighting apparatus by closely arranging the lighting modules 100.

By closely arranging the plurality of lighting modules 100 at the distance D1 between the rows of the light emitting devices, light distribution in each light emitting module 100 and the lighting apparatus having the same is not influenced.

As shown in FIG. 18, by equally setting the distance D1 between the rows of the light emitting devices or the rows of the lens parts of the lens cover, it is possible to uniformly dissipate heat from the light emitting devices.

As shown in FIGS. 18 and 20, a portion of the case 210 is coupled to the case couplers 118 and 119 provided outside the heat dissipating plate 110 of the lighting module 100. Hereinafter, for convenience of description, the coupling structure of the first case coupler 118 located at one side of the heat dissipating plate 100 and the case 210 will be described.

The first case coupler 118 projects from the first rib 12 of the second guide ribs of the heat dissipating plate 110 to the outside and the external height B1 of the first rib 12 may be equal to the thickness B2 of the coupler of the case 210.

The portion of the case 210 is provided on the first case coupler 118 and then is coupled to the coupling hole 18 of the first case coupler 118 through the coupling hole 212 of the case 210 using the third coupling means 209. As shown in FIGS. 21 and 22, the portion of the case 210 provided on the first case coupler 118 may be provided not to project from the upper surface of the second guide ribs. A portion of the upper surface of the case 210 may be the same horizontal surface as the upper end of the first rib 12 or the upper surface of the lighting module 100. The first rib 12 of the lighting module 100 functions as a stopper of the case 210 to prevent the lens part 191 of the lens cover 190 from being damaged by the case 210. The third coupling means 209 includes a screw or a rivet.

Referring to FIG. 23, a nut groove 18A is provided in the lower portion of the first case coupler 118 of the lighting module 100 and the width of the nut groove 18A may be greater than that of the coupling hole 18. If the third coupling means 209 is a screw, a nut 208 may be coupled to the tail of the screw. At this time, the nut 208 may be provided in the nut groove 18A as the screw is coupled. Therefore, the nut groove 18A is provided in the lighting module 100 to locate the nut 208 coupled to the third coupling means 209 in the nut groove 18A.

Referring to FIG. 24, the coupling hole formed in the portion of the case 210 may be formed as a head groove 212A having the same shape as a head part 209A of the third coupling means 209. The head part 209A of the third coupling means 209 is inserted into the head groove 212A. If the third coupling means 209 is a screw, the heat portion 209A of the screw is coupled to the head groove 212A and the tail 209B of the screw is coupled to the coupling hole 18 of the first case coupler 118 of the lighting module 100. At this time, the nut 208 is provided in the lower nut groove 18A of the first case coupler 118 and the nut 208 may be coupled to the tail 209B of the coupling means. The width of the head groove 212A is gradually reduced and the head groove 212A has a width enough to insert the head part 209A of the screw thereinto. Accordingly, the head part 209A of the screw can be completely inserted into the head groove 212A to remove interference caused by the third coupling means 209 coupled to the case 210.

The lighting module 100 according to the embodiment may be arranged in one row in the width direction or may be arranged in two rows in a matrix. As shown in FIG. 25, two rows of lighting modules 100 are coupled in the open region of the case 210A and are connected to connection cables 231 connected to cables 201 and the connection cables 231 may be connected to a driver 220. The driver 220 may efficiently control driving of the lighting modules 100.

The features, structures and effects of the embodiments are included in at least one embodiment of the present invention and are not limited to one embodiment. Further, the features, structures and effects of each embodiment may be combined or modified by those skilled in the art in other embodiments. Accordingly, the description related to such combinations and modifications should be interpreted as being within the scope of the present invention.

Although the preferred embodiments have been disclosed, the embodiments are purely exemplary and do not limit the present disclosure. Those skilled in the art will appreciate that various modifications and applications are possible, without departing from the embodiments. For example, the components described in the embodiments may be modified and embodied. Further, differences related to such modifications and applications should be interpreted as being within the scope of the present disclosure defined by the accompanying claims.

INDUSTRIAL APPLICABILITY

Embodiments can improve reliability lighting module of a light emitting module.

The embodiments are applicable to a lighting apparatus such as an illumination lamp, an indoor lamp, an outdoor lamp, an indicator lamp and a headlight having one or a plurality of lighting modules.

The invention claimed is:

1. A lighting module comprising:

a heat dissipating plate including a plurality of heat dissipating fins disposed thereunder;

a light emitting module including a printed circuit board disposed on the heat dissipating plate and a plurality of light emitting devices disposed on the printed circuit board;

a lens cover having lens parts on the light emitting devices and provided on the printed circuit board; and a waterproof frame disposed between the heat dissipating plate and the lens cover, wherein the waterproof frame includes a first waterproof projection projecting toward a lower surface of the lens cover and a second waterproof projection projecting toward an upper surface of the heat dissipating plate, wherein the waterproof frame has an open region, wherein the heat dissipating plate includes a first groove on an upper portion thereof, wherein the first groove has a cable hole, into which a cable is inserted, and includes a waterproof cap disposed in the first groove, wherein the waterproof cap includes a vertical opening and a guide groove in an uppermost surface of the waterproof cap, the guide groove extending parallel to the uppermost surface, the guide groove extending radially outward from a center of the waterproof cap and in a transverse direction to the vertical opening, and wherein the cable is bent to extend along the guide groove.

2. The lighting module according to claim 1, wherein the heat dissipating plate includes a first guide rib disposed between the waterproof frame and the printed circuit board and second guide ribs disposed outside the waterproof frame and the lens cover.

3. The lighting module according to claim 1, further comprising:

a plurality of lower projections projecting from the lower surface of the lens cover toward an upper surface of the printed circuit board; and coupling holes disposed in the printed circuit board and the heat dissipating plate at the same position, wherein the coupling holes are disposed in a region between the plurality of lower projections.

4. A lighting apparatus comprising:

a plurality of lighting modules; and a case coupled to outsides of the plurality of lighting modules, wherein each of the plurality of lighting modules includes the lighting module according to claim 1.

5. The lighting module according to claim 2, further comprising a heat dissipating pad disposed between the printed circuit board and the heat dissipating plate.

6. The lighting module according to claim 2, wherein:

the heat dissipating plate includes a plurality of projections projecting on opposite side surfaces thereof and a plurality of gaps disposed between the plurality of projections, and the projections extend from the heat dissipating fin.

7. The lighting module according to claim 2, further comprising a first connector coupled to at least one of the upper and lower surfaces of the printed circuit board, wherein the lens cover includes a receiving part in which the first connector of the printed circuit board is disposed.

8. The lighting module according to claim 5, further comprising:

a single first coupling means for coupling the printed circuit board and the heat dissipating pad to the heat dissipating plate; and a plurality of second coupling means for coupling the lens cover and the waterproof frame to the heat dissipating plate.

9. The lighting module according to claim 5, wherein:

the heat dissipating plate includes a heat dissipating body having a receiving region, in which the heat dissipating pad and the printed circuit board are coupled, provided at the upper portion thereof, and the plurality of heat dissipating fins is arranged under the heat dissipating body in a dot type matrix.

10. The lighting module according to claim 6, wherein a plurality of second guide ribs is included and the plurality of second guide ribs are connected to the projections disposed on the side surfaces of the heat dissipating plate.

11. The lighting module according to claim 6, wherein:

a plurality of lighting modules is arranged, and the projections of the heat dissipating plates of the plurality of lighting modules are in contact with each other and the gaps correspond to each other between the projections.

12. A lighting module comprising:

a heat dissipating plate including a plurality of heat dissipating fins on a lower portion thereof and a receiving region on an upper portion thereof;

a light emitting module including a printed circuit board disposed on the heat dissipating plate and a plurality of light emitting devices disposed on the printed circuit board;

a lens cover having lens parts on the light emitting devices and provided on the printed circuit board; and a waterproof frame disposed between the heat dissipating plate and the lens cover, wherein the waterproof frame includes a plurality of first waterproof projections projecting toward a lower surface of the lens cover and a plurality of second waterproof projections projecting toward an upper surface of the heat dissipating plate, wherein the waterproof frame has an innermost perimeter and an outermost perimeter, the innermost perimeter defining an open region, wherein the heat dissipating plate includes a first guide rib disposed between the printed circuit board and the innermost perimeter of the waterproof frame and a second guide rib spaced from the first guide rib and disposed outside the outermost perimeter of the waterproof frame such that the waterproof frame is located between the first guide rib and the second guide rib, wherein the heat dissipating plate includes a first groove on the upper portion thereof, and wherein the first groove has a cable hole, into which a cable is inserted, and includes a waterproof cap disposed in the first groove.

13. The lighting module according to claim 12, further comprising a first ring projection projecting from a surface of the waterproof cap, the first ring projection being circular.

14. The lighting module according to claim 12, wherein:

the number of heat dissipating fins is five or more times the number of light emitting devices, and each of the heat dissipating fins has a thickness gradually decreasing from an upper surface of the heat dissipating plate.

15. The lighting module according to claim 12, wherein a first thickness of the waterproof frame at the innermost perimeter is greater than a height of the first rib, a second thickness of the waterproof frame at the outermost perimeter adjacent the second rib is less than a height of the second rib, and the first thickness is greater than the second thickness.

16. The lighting module according to claim 13, wherein:

a plurality of first ring projections is disposed on a surface of the waterproof cap, and the plurality of first ring projections has different external diameters.

17. The lighting module according to claim 13, wherein:

the heat dissipating plate includes a hooked step adjacent to the first groove, and the waterproof cap includes a hooked projection coupled to the hooked step.

18. The lighting module according to claim 16, wherein:

the waterproof cap includes a stepped structure in which widths of upper and lower portions thereof are different, and the plurality of first ring projections is disposed on the upper and lower portions of the waterproof cap.

19. The lighting module according to claim 16, wherein the waterproof cap includes a plurality of second ring projections projecting from a surface of the cable hole.

20. The lighting apparatus according to claim 4, wherein the heat dissipating plate of the lighting module includes a plurality of case couplers at an outside thereof.

21. The lighting apparatus according to claim 20, wherein the case coupler includes a coupling hole having a head groove, into which a portion of a coupling means is inserted.

* * * * *